US005525054A

United States Patent [19]

Nakaura et al.

[11] Patent Number: 5,525,054

[45] Date of Patent: Jun. 11, 1996

[54] BURNER DEVICE AND A METHOD OF MAKING THE SAME

[75] Inventors: Masaaki Nakaura; Hideo Okamoto; Hideaki Ishikawa; Kazuo Yagi, all of Nagoya, Japan

[73] Assignee: Rinnai Kabushiki Kaisha, Nagoya, Japan

[21] Appl. No.: 118,626

[22] Filed: Sep. 10, 1993

[30] Foreign Application Priority Data

| | | | |
|---|---|---|---|
| Sep. 11, 1992 | [JP] | Japan | 5-243697 |
| Sep. 11, 1992 | [JP] | Japan | 5-243698 |
| Sep. 14, 1992 | [JP] | Japan | 5-243889 |
| May 24, 1993 | [JP] | Japan | 5-121141 |
| Aug. 3, 1993 | [JP] | Japan | 5-192593 |

[51] Int. Cl.[6] ..... F23M 3/06; F23D 14/12

[52] U.S. Cl. ..... 431/285; 431/326; 431/328; 431/349

[58] Field of Search ..... 431/328, 326, 431/354, 349, 346, 278, 285, 2; 126/39 R, 41 R, 116 R, 110 R

[56] References Cited

U.S. PATENT DOCUMENTS

| | | | |
|---|---|---|---|
| 3,047,056 | 7/1962 | Flynn | 431/349 X |
| 5,368,476 | 11/1994 | Sugahara et al. | 431/285 |

FOREIGN PATENT DOCUMENTS

| | | | |
|---|---|---|---|
| 0331037 | 2/1989 | European Pat. Off. . | |
| 0534554 | 9/1992 | European Pat. Off. . | |
| 1414633 | 9/1965 | France | 431/349 |
| 0024341 | 2/1977 | Japan | 431/285 |
| 0069311 | 4/1983 | Japan | 431/354 |
| 0052116 | 3/1984 | Japan | 431/354 |
| 1-310218 | 12/1989 | Japan | 126/116 R |
| 3-247908 | 11/1991 | Japan . | |
| 3-263505 | 11/1991 | Japan . | |
| 1954115 | 10/1969 | Netherlands . | |
| 3906795 | 9/1989 | Netherlands . | |
| 1111556 | 5/1968 | United Kingdom . | |
| 1297005 | 11/1972 | United Kingdom . | |

*Primary Examiner*: Carl D. Price

*Attorney, Agent, or Firm*: Sughrue, Mion, Zinn, Macpeak & Seas

[57] ABSTRACT

In a gas burner device having a first burner having a first fire hole formed therein and a second burner having a second fire hole arranged therein, the fire hole is disposed around the first fire hole of a first burner to straddle the first fire hole. The second burner has a common suction hole through which a fuel gas and primary air are supplied to the second fire hole independent of fuel gas and primary air supplied to the first burner.

3 Claims, 25 Drawing Sheets

1
13C
13B
13A
13

132
1
13C
161
161
19
161
161
11
131
13B
13A
13
18
16
14
15
12

1
132
14
131
13
13C
18
13B
13A
12

73
73

74
77
78
77
74

75
75

76
77
78
77
76 in term of A-level characteristics

BURNER DEVICE AND A METHOD OF MAKING THE SAME

BACKGROUND OF THE INVENTION

1. Field of the Invention

This invention relates to a burner device and a method of making the burner device which is suited to be used as a heating source of a water heater device.

2. Description of Prior Art

In a burner device used for a water heating apparatus, a second burner has a second fire hole provided in a manner to sandwich a first fire hole of a first burner as shown in Japanese Patent Provisional Publication No. 3-263505. In such a water heating apparatus, a row array of the burner devices are arranged at regular intervals in which an air-fuel mixture is supplied to the first fire hole and the second fire hole through an individual nozzle.

The first fire hole predominantly burns an air-rich fuel which is leaner than a stoichimetric air-fuel ratio, while the second fire hole burns a fuel-rich mixture which is richer than the stoichimetric air-fuel ratio. This makes it possible to substantially hold a uniform air-fuel mixing ratio so as to reduce an emission of nitric oxide (NOx) to 40~60 ppm compared to an existing art in which the emission is around 120 ppm. It is also possible to burn the fuel-rich mixture at the first fire hole, and burning the air-rich fuel at the second fire hole to reduce the emission of nitric oxide (NOx).

In this type of the water heating apparatus, however, three suction holes and three nozzles are required to supply the air-fuel mixture to a row of three fire holes. This requires complicated procedures to adjust the air-fuel ratio due to dimensional variations of assembling elements so as to make the whole structure more complex and expensive.

Therefore, it is one object of the invention to provide a burner device which is capable of simplifying air-fuel supplying system and readily adjusting the air-fuel ratio to reduce the manufacturing cost.

It is another object of the invention to provide method of making a burner device which is capable of being readily manufactured and thus reduce the manufacturing cost by enclosing a metal plate around a first burner to form a second fire hole.

It is still another object of the invention to provide a method of making a burner device which is capable of uniformly distributing the air-fuel mixture which is supplied to two second fire holes provided at both sides of the first burner.

It is one object of the invention to provide a burner device which is capable of reducing a level of noise by dividing the first fire hole into flame holes.

These and other objects and advantages of the invention will be apparent upon reference to the following specification, attendant claims and drawings.

SUMMARY OF THE INVENTION

According to the invention, there is provided a burner device in which a second burner is provided which has a second fire hole arranged at both sides of a first fire hole of a first burner in a manner to straddle the first fire hole. The second burner independently has a common suction hole through which a fuel gas and a primary air are supplied to the second fire hole independent of the first burner.

According to the invention, there is provided a burner device which includes a first flat metal burner an upper end of which has a main fire hole, and a second flat metal burner in which a slit-like sleeve fire hole is provided at both sides of the main fire hole in a manner to straddle the first fire hole. The second burner independently has a common suction hole through which a fuel gas and a primary air are supplied to the second fire hole independent of the first burner.

According to the invention, there is provided a method of making a gas burner device comprising steps of symmetrically blanking a metal plate and deforming it so as to form an intermediate blank; bending the intermediate blank at a symmetrical center to provide a first burner flow path, and at the same time, bonding non-bulged portions to form a first burner; blanking a metal plate and symmetrically deforming it so as to form an intermediate blank; bending the intermediate blank at a symmetrical center to provide a cover plate; enclosing at least an upper end of the first burner to form a slit-like sleeve fire hole by a bended portion at the symmetrical center, and at the same time, forming a second burner flow path communication with a common suction hole and a slit-like sleeve fire hole so as to provide a second burner.

According to the invention, there is provided a method of making a gas burner device wherein one end of the first burner flow path has a suction hole, a first burner inlet horizontally extending from one end to the other end of the first burner flow path, a first burner middle portion rising up from an opposite end of the first burner inlet and a first outlet extending from an upper end of the burner middle portion to communicate with the first fire hole, a cylindrical body being horizontally formed which has one end to act as a second burner suction hole between the first burner inlet and the second burner outlet, and having the other end to serve as a communication hole communicating with a flow path of the second burner.

According to the invention, there is provided a method,of making a gas burner device wherein the communication hole comprises a row of small holes arranged at the other end of the cylindrical body in an axial direction.

According to the invention, there is provided a method of making a gas burner device wherein the communication hole comprises two rows of small holes symmetrically arranged at the other end of the cylindrical body.

According to the invention, there is provided a gas burner device wherein the first fire hole comprises a multitude of horizontally arrayed slits.

According to the invention, there is provided a gas burner device wherein the first fire hole comprises a multitude of extensively arrayed holes.

According to the invention, there is provided a gas burner device wherein a multitude of the extensively arrayed holes are provided on a metallic plate in a matrix-like configuration.

According to the invention, there is provided a gas burner device wherein a multitude of the extensively arrayed holes are provided by laminating a corrugated plate and flat plate.

According to the invention, there is provided a gas burner device in which a second fire hole of a second burner is provided at both sides of a first fire hole of a first burner, and a suction hole is provided to introduce a fuel gas independently of the first burner. A burn-limit exceeding fuel-rich mixture is supplied to one of the first burner and the second burner, while an air rich-fuel is supplied to the other of the first burner and the second burner, and a communication path being provided in the proximity of the second burner so as to introduce the air-rich fuel to the burner to which the fuel-rich mixture is supplied.

According to the invention, there is provided a burner device in which a sleeve burner is provided to form a slit-like sleeve fire hole at a side of a flat main burner, and the sleeve burner has a suction hole to introduce a mixture of a primary air and fuel gas, and an air-rich fuel is supplied to the main burner, while a fuel-rich mixture is suppied to the sleeve burner. A constricted neck portion is provided within the sleeve burner at an upper reach of the sleeve fire hole so as to prevent a back fire.

According to the invention, there is provided a burner device wherein the sleeve burner has the slit-like sleeve fire hole at both sides of the main fire hole of the main burner in a manner to sandwich the main fire hole.

According to the invention, there is provided a burner device in which a sleeve burner forms a sleeve fire hole to burn fuel-rich mixture at a side of a main hole of a main burner which burns an air-rich fuel. The sleeve fire hole is partially covered to divide it into a multitude of flame holes.

According to the invention, there is provided a burner device in which a main burner forms a flat main fire hole to burn an air-rich fuel, and a sleeve burner is provided to form a sleeve fire hole at both sides of the main burner so as to burn a fuel-rich mixture. The sleeve burner forms a plurality of rectangular blanks and small holes at both sides of the rectangular blanks to provide the sleeve fire holes at a center of a metal plate, and symmetrically provide a bulged portion at opposed portions of the metal plate, and the metal plate is bent at its center line so as to form a cover plate which encloses the main burner, a part of the metal plate in which the small holes are provided serving as a lid plate to partly cover the sleeve fire hole.

According to the invention, there is provided a burner device in which a main burner forms a flat main fire hole to burn an air-rich fuel, and a sleeve burner is provided to form a sleeve fire hole at both sides of the main burner so as to burn a fuel-rich mixture. The sleeve burner forms a plurality of rectangular blanks and small holes at both sides of the rectangular blanks to provide the sleeve fire holes at a center of a metal plate, and symmetrically provide a bulged portion at opposed portions of the metal plate, and the metal plate is bent at its center line so as to form a cover plate which encloses the main burner, a part of the metal plate which bridges between the rectangular blanks serving as a lid plate to partly cover the sleeve fire hole.

With the common hole provided with the second burner, it is possible to supply the air-fuel mixture to two second fire holes placed at both sides of the first burner by way of a single nozzle. This makes it possible to adjust the air-fuel ratio with easy operation because of the reduced number of nozzles and suction holes.

With the two sleeve fire holes provided by enclosing a metal plate around the first burner, it is possible to readily manufacture the sleeve fire holes with a reduced manufacture cost.

With the communication hole provided by axially arranged row of small holes, it is possible to evenly supply the air-fuel mixture to the second burner along the two sleeve fire holes so as to enhance a stability of the burning condition.

By providing the first fire hole as a multitude row of slits, it is possible to reduce a combustion power per slit which decreases the flame vibration due to partial burning when operated at a lean air-fuel limit. This means to reduce the vibration energy of the flame per slit so as to reduce the noise due to the flame vibration.

By providing the first fire hole as extensively distributed small holes, it is possible to further reduce the size of the holes so as to decrease the noise due to the flame vibration.

With the air-rich fuel supplied to the burning-limit exceeding fuel-rich mixture by way of the communication path so as to rarefy to a burnable air-fuel ratio, the flames are drawn to only where the burnable mixture exists even when the flow of the fuel-rich mixture slows at the time of operating with a low burning load. This makes it possible to protect a peripheral elements of the burner device against overheating, and also makes it possible to prevent carbon deposits, misfire and noise in the burner so as to assure safety.

With the constricted neck portion provided somewhat at the upper reach of the sleeve fire hole, a back fire stops at the constricted neck portion when the flow of the air-fuel mixture slows from the sleeve fire hole so as to cause the back fire at the time of operating with a low burning load. This makes it possible to protect peripheral elements of the burner device against overheating, and also makes possible to prevent carbon deposits, misfire and noise in the burner so as to assure safety.

With a lid cover provided to partly cover the sleeve fire hole and divide it into a multitude of flame holes, it is possible to increase the speed of the gas-fuel mixture so as to avoid the back fire and deformation of the sleeve fire hole under the condition in which the fuel-rich burning often tends to cause the back fire and uneven burning in the sleeve fire hole. This makes it possible to protect peripheral elements of the burner device against overheating, and also makes it possible to prevent carbon deposits, misfire and noise in the burner so as to assure safety.

By manufacturing the lid cover in integral with the sleeve burner, it is possible to reduce the manufacturing cost.

With the first fire hole represented by a multitude of small fire holes arranged in the form of plannar configuration, it is possible to reduce the fire holes so as to further decrease the noise level.

With the first fire hole provided between the ribbon metals, the necessity of welding procedure is obviated so as to reduce the dimensional variation due to thermal strain.

The partition zone is provided between the first fire hole and second fire hole.

DETAILED DESCRIPTION OF THE EMBODIMENTS

Figure 1:
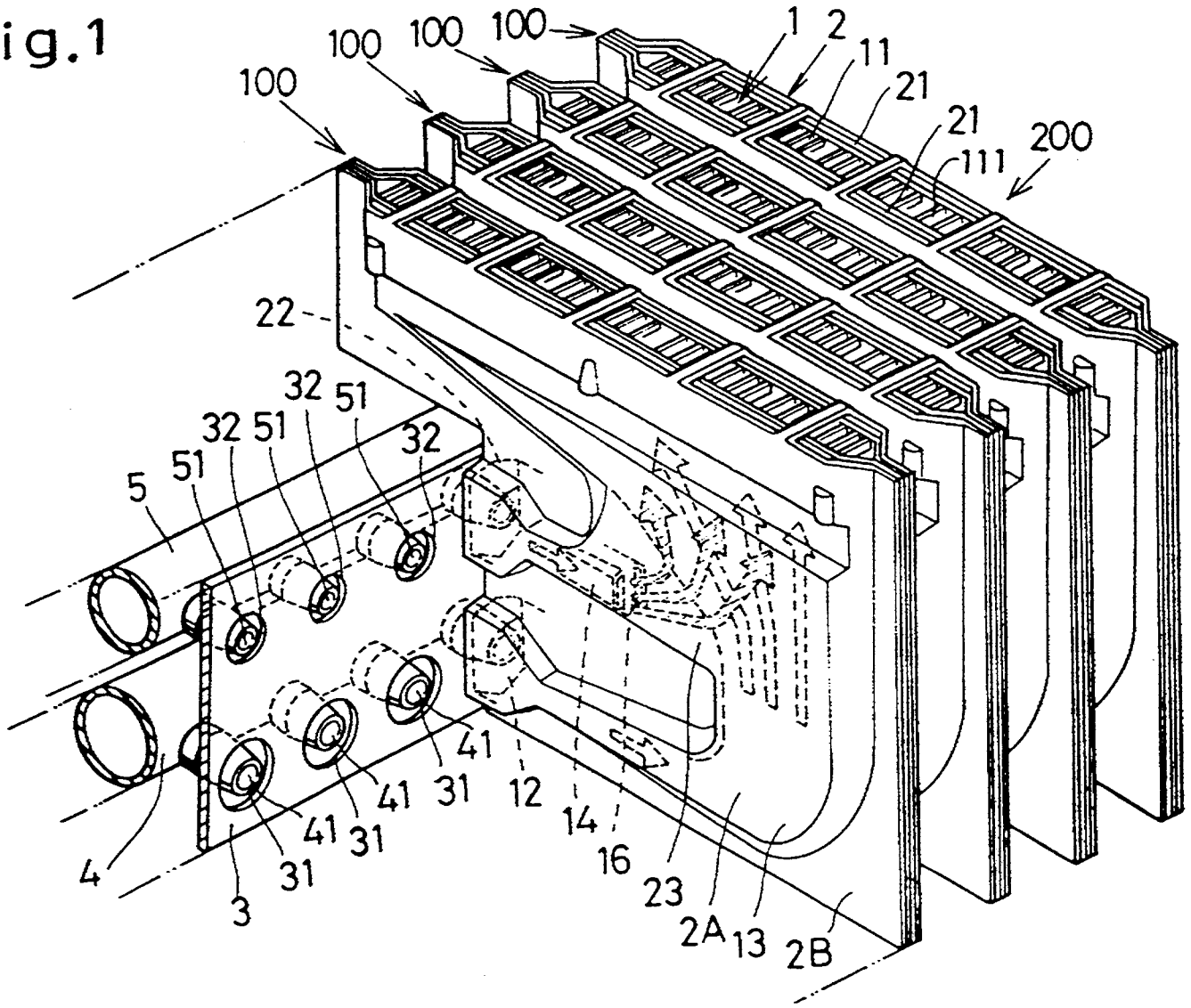
FIG. 1 is a perspective view of a water heating apparatus into which a gas burner device is incorporated according to a first embodiment of the invention.
Figure 2B:
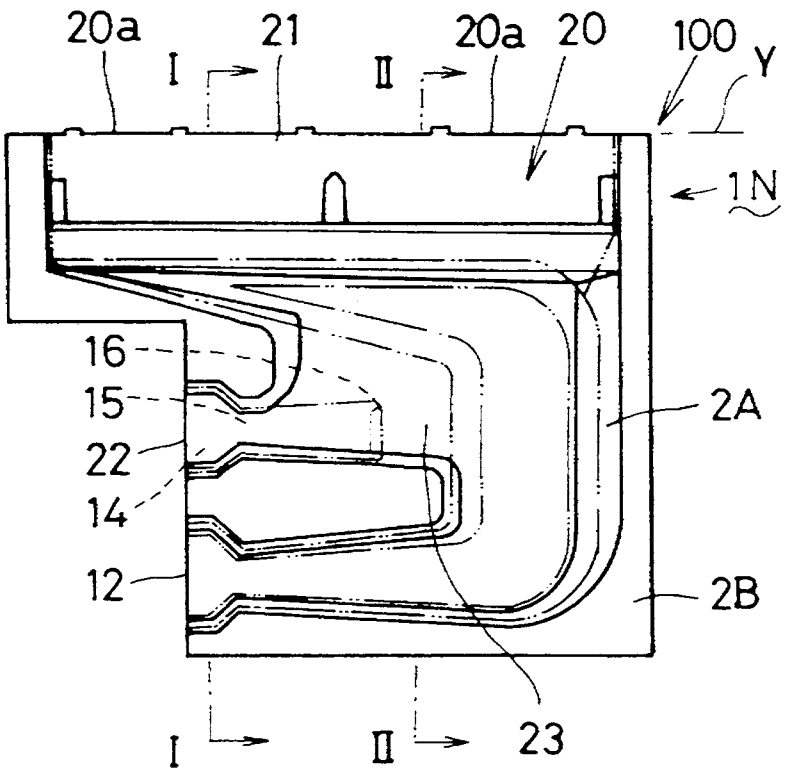
FIG. 2*b* is a side elevational view of the gas burner.
Figure 2A:
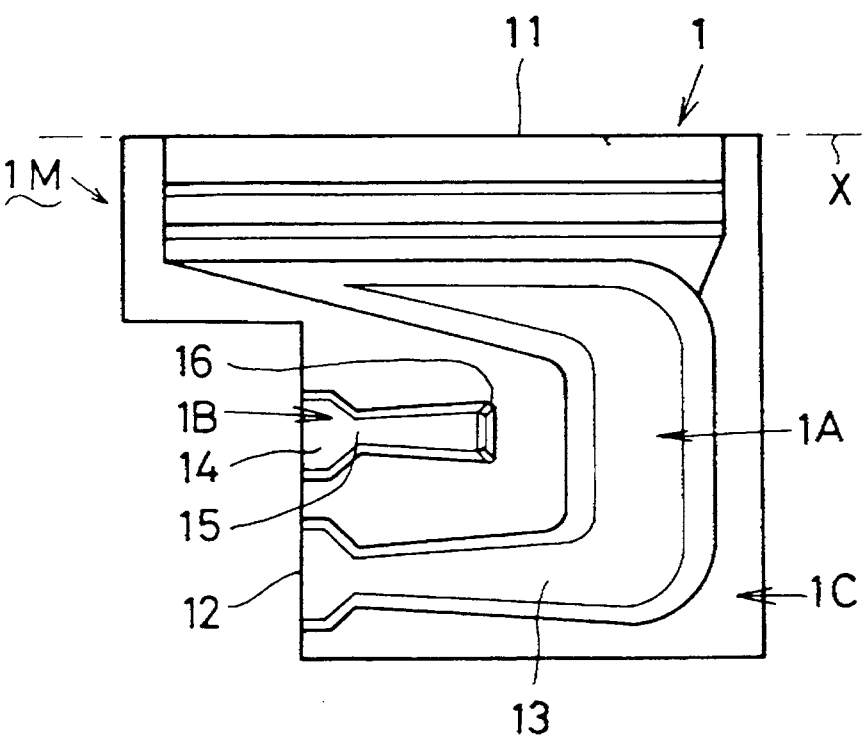
FIG. 2*a* is a side elevational view of a main burner.
Figure 2C:
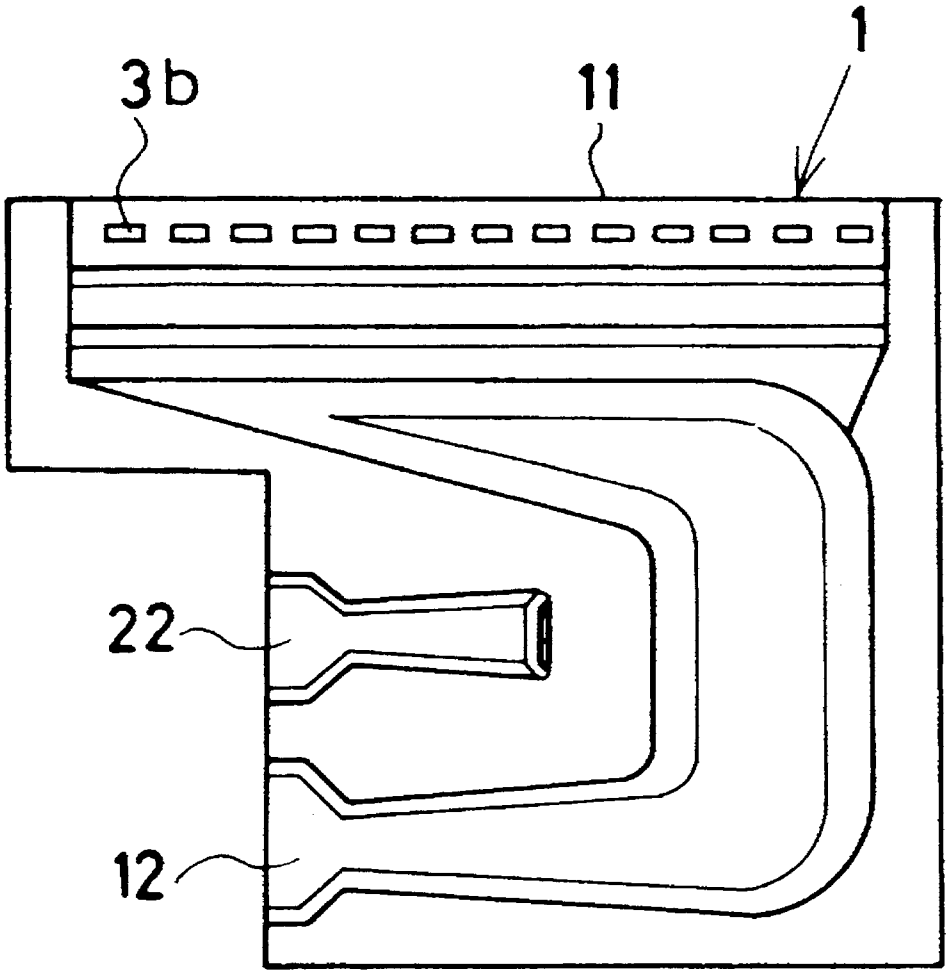
FIG. 2*c* is a view similar to FIG. 2*b* according to a modified form of the first embodiment of the invention.
Figure 3A:
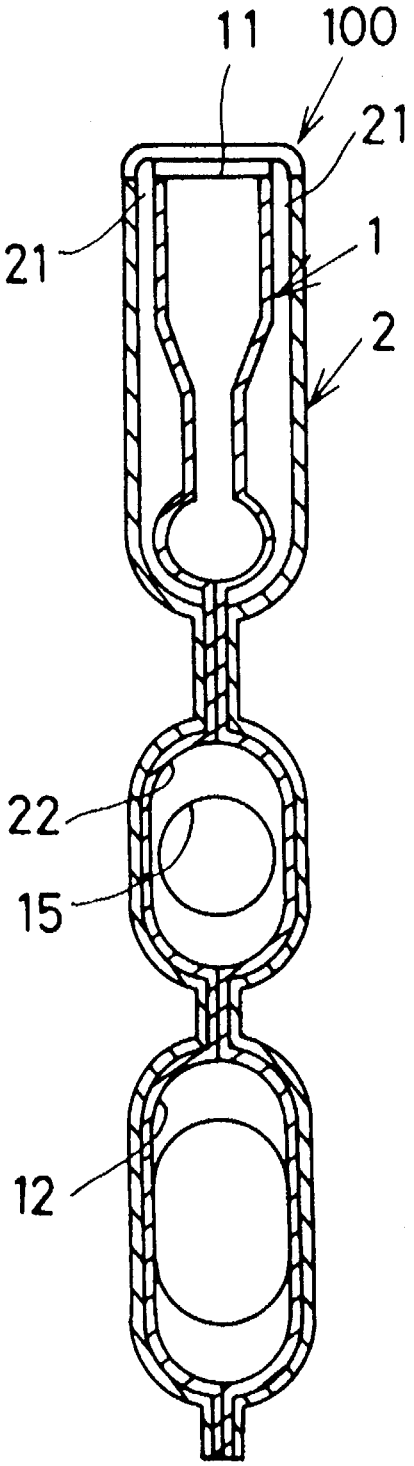
FIG. 3*a* is a latitudinal cross sectional view of a main burner along taken the line I—I of FIG. 2*b;*
Figure 3B:
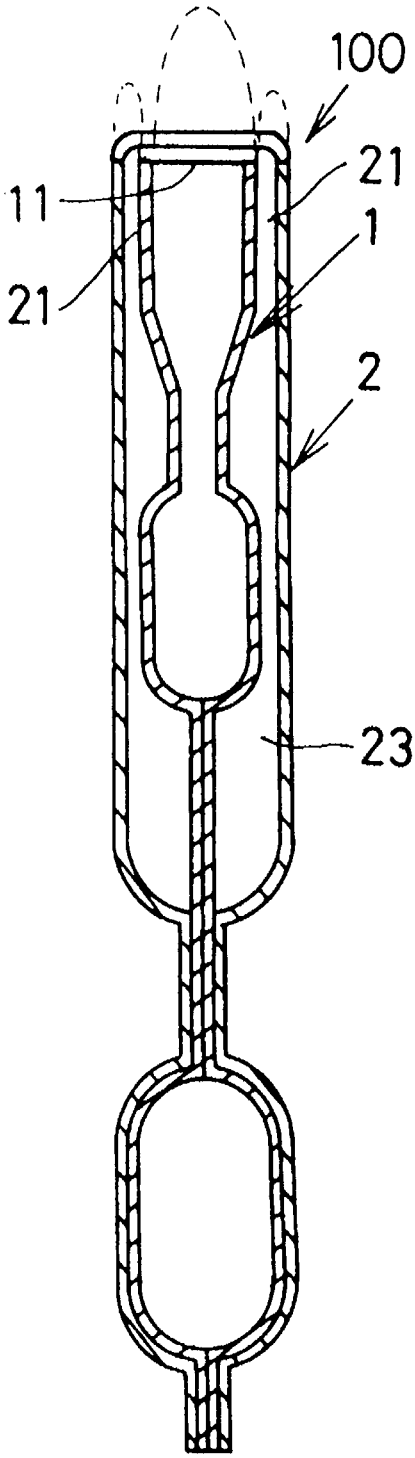
FIG. 3*b* is a latitudinal cross sectional view of the gas burner device taken along the line II—II of FIG. 2*b;*

Referring to FIG. 1 which shows a burner device 100 for a water heating apparatus according to a first embodiment of the invention, the burner device 100 is supported by a frame (not shown), and having a heating source 200 arranged at regular intervals. At an upper end of each of the burner devices, an oblong main fire hole 11 is provided to serve as a first fire hole. At a side of each of the burner devices, a flat type main burner 1 (first burner) is provided which has a suction hole 12 through which an air-fuel mixture is drawn. In the neighborhood of both sides of the main fire hole 11, a slit-like sleeve holes 21, 21 are provided to serve each of them as a second fire hole. At a lower end of each of the burner devices, a sleeve burner 2 (second burner) is provided which has a common suction hole 22. In the suction hole 12 of the main burner 1 and the suction hole 22 of the sleeve burner 2, a damper 3 is provided which has a throttle hole 31 (32) to adjust a primary air of each of the burners. In manufacturing the main burner 1, a multitude of rows of slits are blanked from a metal plate to form the main fire hole 11 at a central position of the main fire hole 11, while bulged portions 1A, 1B are symmetrically provided on a metal plate 1M with a center line X as a symmetrical plane as shown in FIGS. 2*a*, 2*b*. Except for the portion in which the main fire hole 11 exists, the metal plate 1M is bent in U-shaped configuration with an upper end as the center line X to overlap a flat portion 1C of the metal plate 1M. The overlapped flat portion 1C is bonded by means of a spot welding as shown in FIGS. 2*a*, 3*a* and 3*b*. It is noted that a marginal end of the flat portion 1C is preferably inturned to form a U-shaped end so as to insure the gas leakage prevention. Thus the main fire hole 11 is formed on its upper end which has a multitude row of slits 111, and one end of the bulged portion 1A forms the suction hole 12 for the air-fuel mixture, while an inside of the bulged portion 1A forms a flow path 13 which communicates the suction hole 12 with the main fire hole 11 as shown in FIGS. 2*a*, 3*a* and 3*b*. With the provision of the bulged portion 1B, a suction hole 14, a throat portion 15 and a throat outlet 16 of the sleeve burner 2 are each formed above an upper end of the suction hole 12. It is observed that instead of using a sheet of metal plate, the main burner may be made by means of welding, forging or other manufacturing processes. It is noted that a plurality of slit-like communication passage 3*b* may be provided in an upper side of the metal plate 1M to communicate a flow path of the burner 1 with the sleeve fire hole 21 as shown in FIG. 2*c*.

Figure 4:
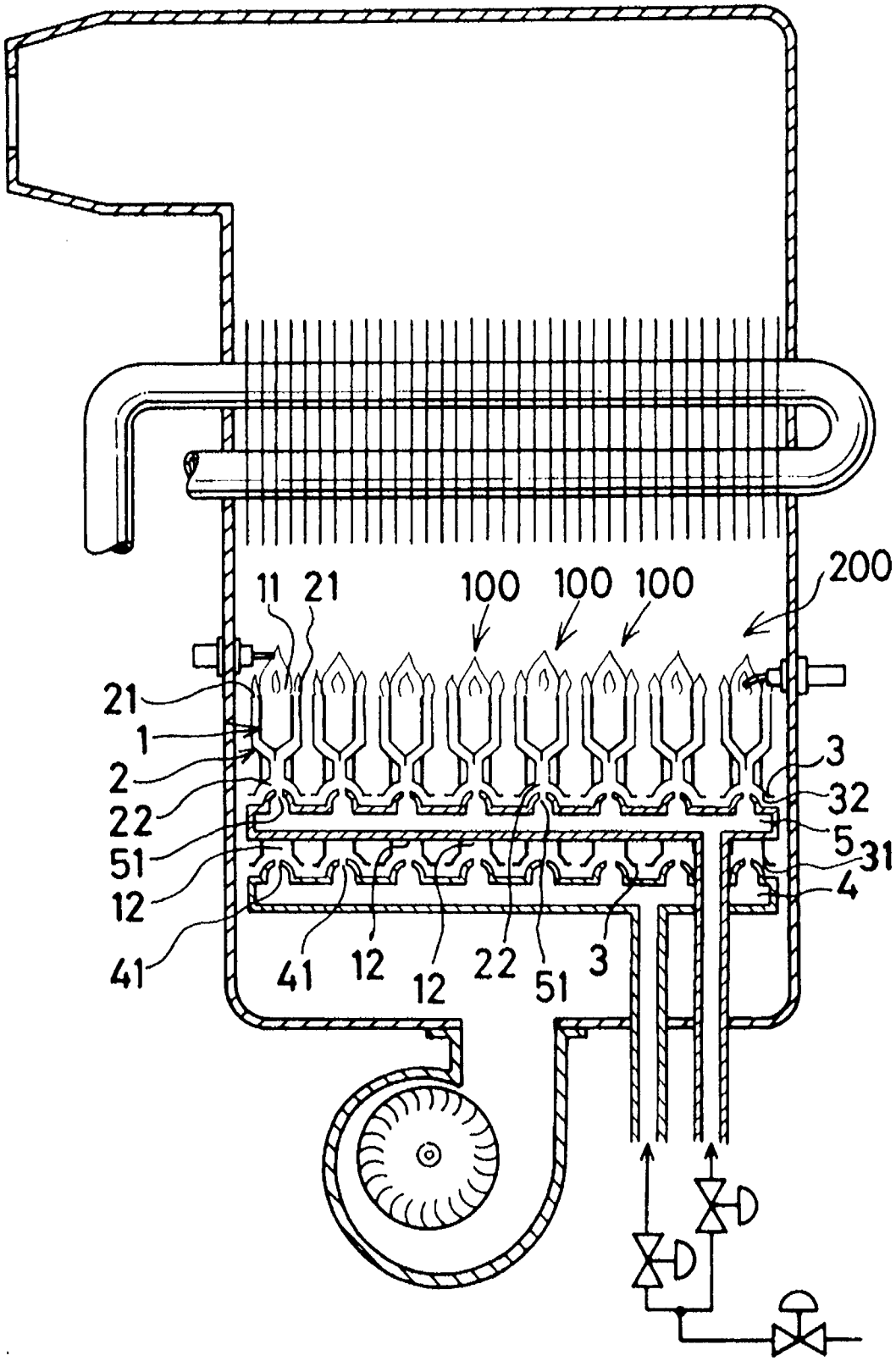
FIG. 4 is a schematic view of the water heating apparatus into which the gas burner device is incorporated.

On the other hand, the sleeve burner 2 is manufactured as follows:

A plurality of rectangular blanks 20*a* are formed on a central position of a metal sheet 1N, and a bulged portion 1A is symmetrically provided at both sides of the metal sheet 1N. Then the metal sheet 1N is bent in U-shaped configuration with an upper end as a center line Y so as to provide a cover plate 20 as shown in FIGS. 2*b*, 3*a* and 3*b*. The cover plate 20 is assembled to enclose the main burner 1 so as to overlap a flat portion 2B of the cover plate 20 with the flat portion 1C of the main burner 1. The overlapped flat portions 1C, 2B are bonded by means of a spot welding as shown in FIGS. 2*b*, 3*a* and 3*b*. It is noted that a marginal end of the flat portion 2B is preferably inturned to form a U-shaped end in order to insure the gas leakage prevention. In this instance, a bulged portion 2A encloses the main fire hole 11, the suction hole 12 and the flow path 13 of the main burner 1, and forming the slit-like sleeve fire holes 21, 21 and the common suction hole 22. At both sides of the main burner 1, a flow path 23 is formed which communicates the common suction hole 22 with the sleeve fire holes 21, 21. The main fire hole 11 and the sleeve fire holes 21, are located to look up the rectangular blanks 20*a*. The suction hole 14, the throat portion 15 and the throat outlet 16 of the sleeve burner 2 are brought to fit into the common suction hole 22. With this structure, an air and a fuel gas are drawn from the common suction hole 22, and mixed at the throat portion 15 to reach the throat outlet 16 in which the mixture of the air and the fuel gas is distributed evenly to the two sleeve fire holes 21, 21. As shown in FIGS. 1 and 4, fuel gas supply pipes 4, 5 are disposed to correspond to the throttle holes 31, 32 of the damper 3 which is arranged in the suction hole 12 of the main burner 1 and the suction hole of the sleeve burner 2. The fuel gas supply pipes 4, 5 have individual nozzles 41, 51. The fuel gas supplied from the nozzle 41 meets the primary air at the throttle hole 31 to reach the flow path 13 by way of the suction hole 12 so as to burn at the main fire hole 11 as shown in FIG. 3. The fuel gas supplied from the nozzle 51 meets the primary air at the throttle hole 32 to reach the flow path 23 by way of the suction hole 22 and the throat portion 15 so as to bifurcate to both sides of the main fire hole 11 burn to burn at the sleeve fire holes 21, 21.

In this instance, the air-rich fuel mixture is supplied to the main burner 1. The air ratio of the mixture is 1.4 by way of illustration. On the other hand, the fuel-rich mixture is supplied to the sleeve burner 2. The air ratio of the fuel-rich mixture is 0.8 for example. Because of the high air ratio of the air-rich fuel mixture, the main burner 1 emits less nitric oxide (NOx). Because of the low air ratio of the fuel-rich mixture, the sleeve burner 2 also emits less nitric oxide (NOx).

By forming the main fire hole 11 as a multitude row of slits, it is possible to reduce the quantity of combustion per slit, thus enabling to reduce the flame vibration which often occurs due to partial burning at the time of operating in the range of lean air-fuel ratio. This also leads to reducing the noise due to the flame vibration because the vibration energy of the flame decreases at each of the slits 111. With this structure, it enables to reduce the emission of the nitric oxide (NOx) to 40~60 ppm as opposed to the existing art in which the emission of the nitric oxide (NOx) is approximately to 120 ppm when the air-fuel gas mixture is burned with its air ratio as 1.2.

The above shows that it is important to adjust the air fuel ratio of the mixture supplied to each of the main burner 1 and the sleeve burner 2 in reducing the emission of the nitric oxide (NOx). The adjustment of the air fuel ratio involves in appropriately arranging diameter and position of the nozzle 41, 51 and diameter and position of the throttle holes 31, 32. With the single common suction hole 22 supplying the mixture to the sleeve fire holes 21, 21, it is possible to reduce the number of nozzles 51 and throttle holes 32 of the sleeve,burner 2 so as to quickly adjust the air-fuel ratio. This makes it possible to readily assemble the elements upon producing the gas burner device. Further, the sleeve burner 2 is made from the metal sheet 1N by means of press, and assembled to enclose the main burner 1, thus making it possible to manufacture the gas burner device with a low cost.

The suction hole 12 of the main burner 1 is located below the suction hole 22 of the sleeve burner 2 because a relatively long flow path is required to completely mix the air and the fuel gas.

Figure 5B:
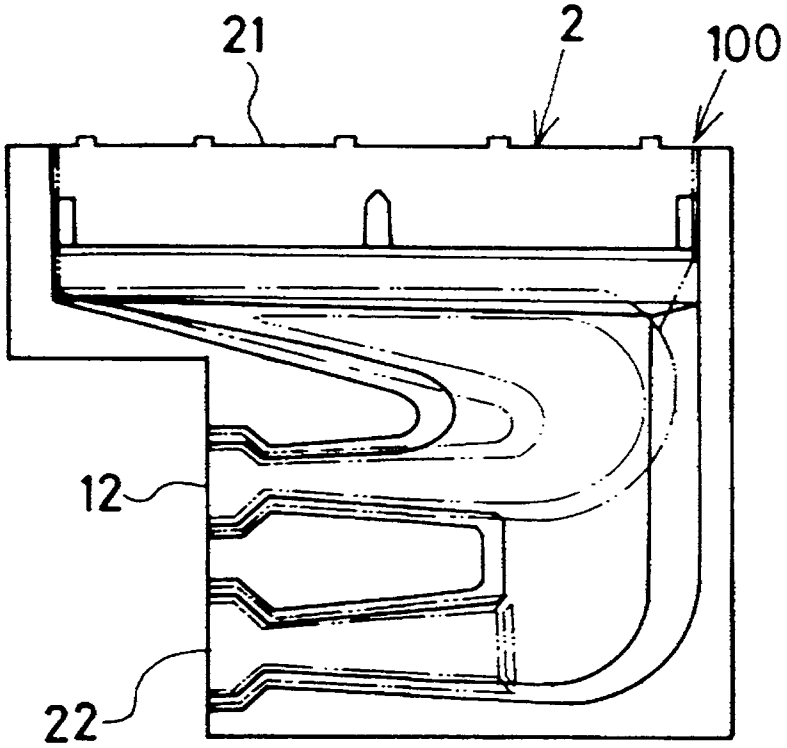
FIG. 5*b* is a side elevational view of the gas burner device according to the second embodiment of the invention.
Figure 5A:
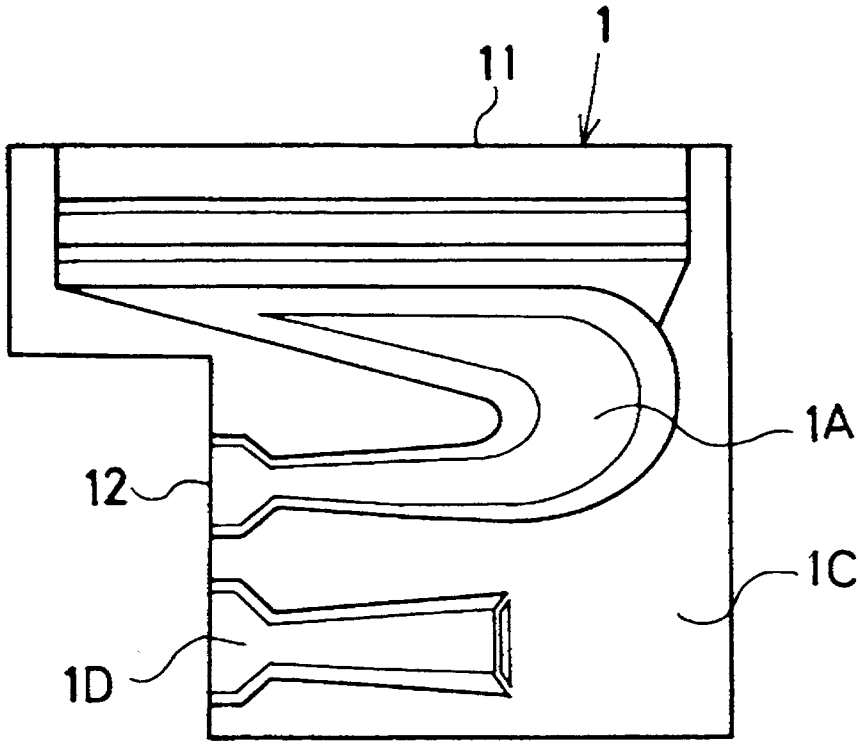
FIG. 5*a* is a side elevational view of the main burner according to a second embodiment of the invention.

It is appreciated that the fuel-rich mixture may be supplied to the main burner 1, while the air-rich fuel may be supplied to the sleeve burner 2 as shown in FIG. 5. In this instance, it is preferable to locate the suction hole 12 of the main burner 1 above the suction hole 22 of the sleeve burner 2 according to a second embodiment of the invention. In FIG. 5, a bulged portion 1D serves as the bulged portion 1B in FIG. 2.

Figure 6B:
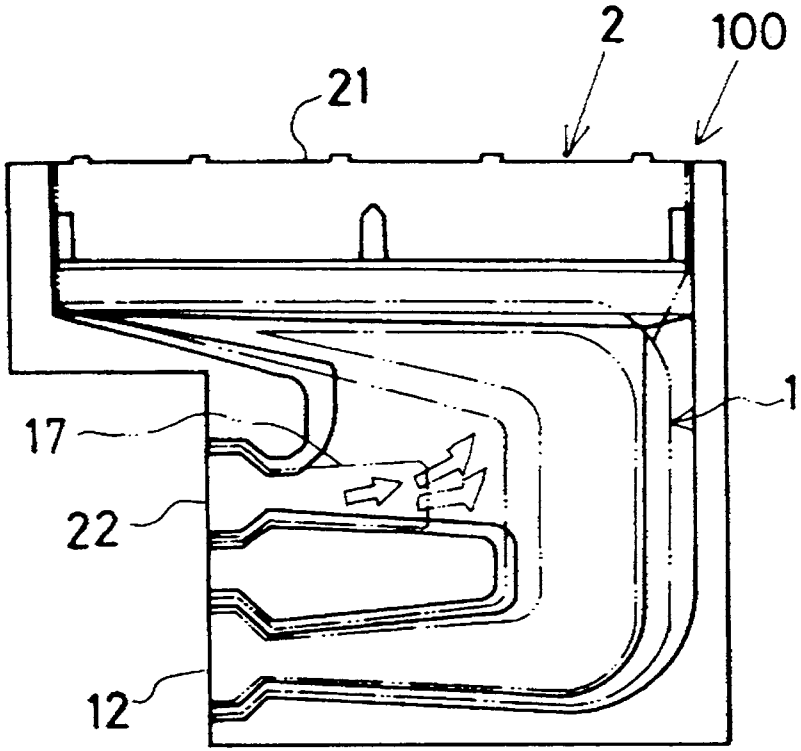
FIG. 6*b* is a side elevational view of the gas burner device according to the third embodiment of the invention.
Figure 6A:
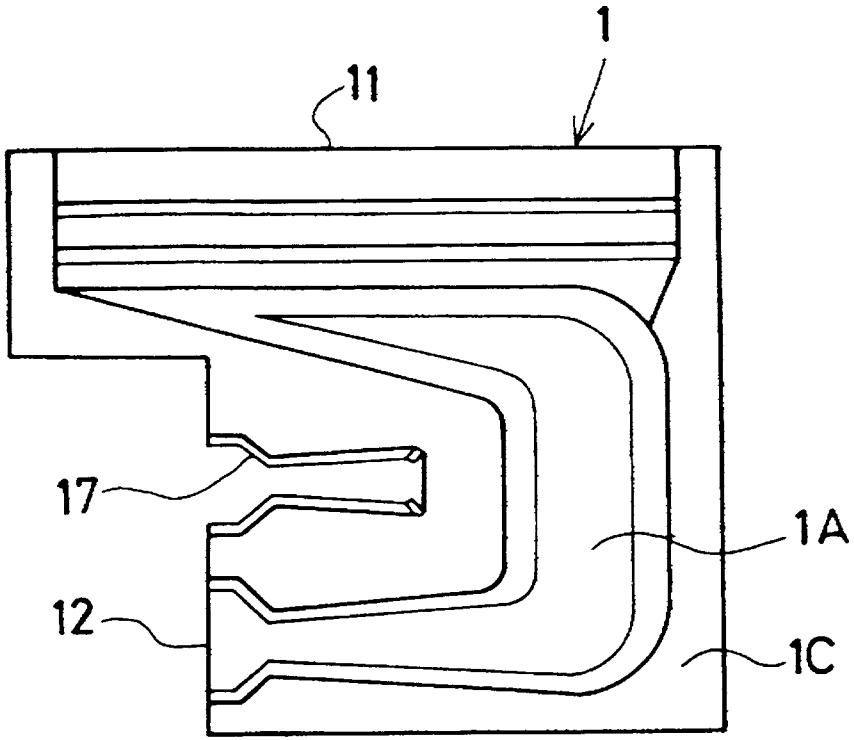
FIG. 6*a* is a side elevational view of the main burner according to a third embodiment of the invention.

FIG. 6*a*, 6*b* shows a third embodiment of the invention in which a notch portion 17 is provided with the main burner 1 which corresponds to the suction hole 14, the throat portion 15 and the throat outlet 16 of the sleeve burner 2. It is also observed that the notch portion 17 may be applied to the bulged portion 1D in FIG. 5.

When the gas burner device 100 is applied to a gas burning apparatus which extensively adjust the quantity of combustion, the back fire often occurs at the burner to which the fuel-rich mixture is supplied. In order to avoid the occurrence of the back fire, it is desirable to divide the sleeve fire hole 21 into a multitude of flame holes which substantially decreases an opening area of the sleeve fire hole 21 to form rows of small flame holes. The sleeve fire hole 21, thus divided into the rows of small flame holes, can be readily made when blanking the cover plate 20.

Figure 7:
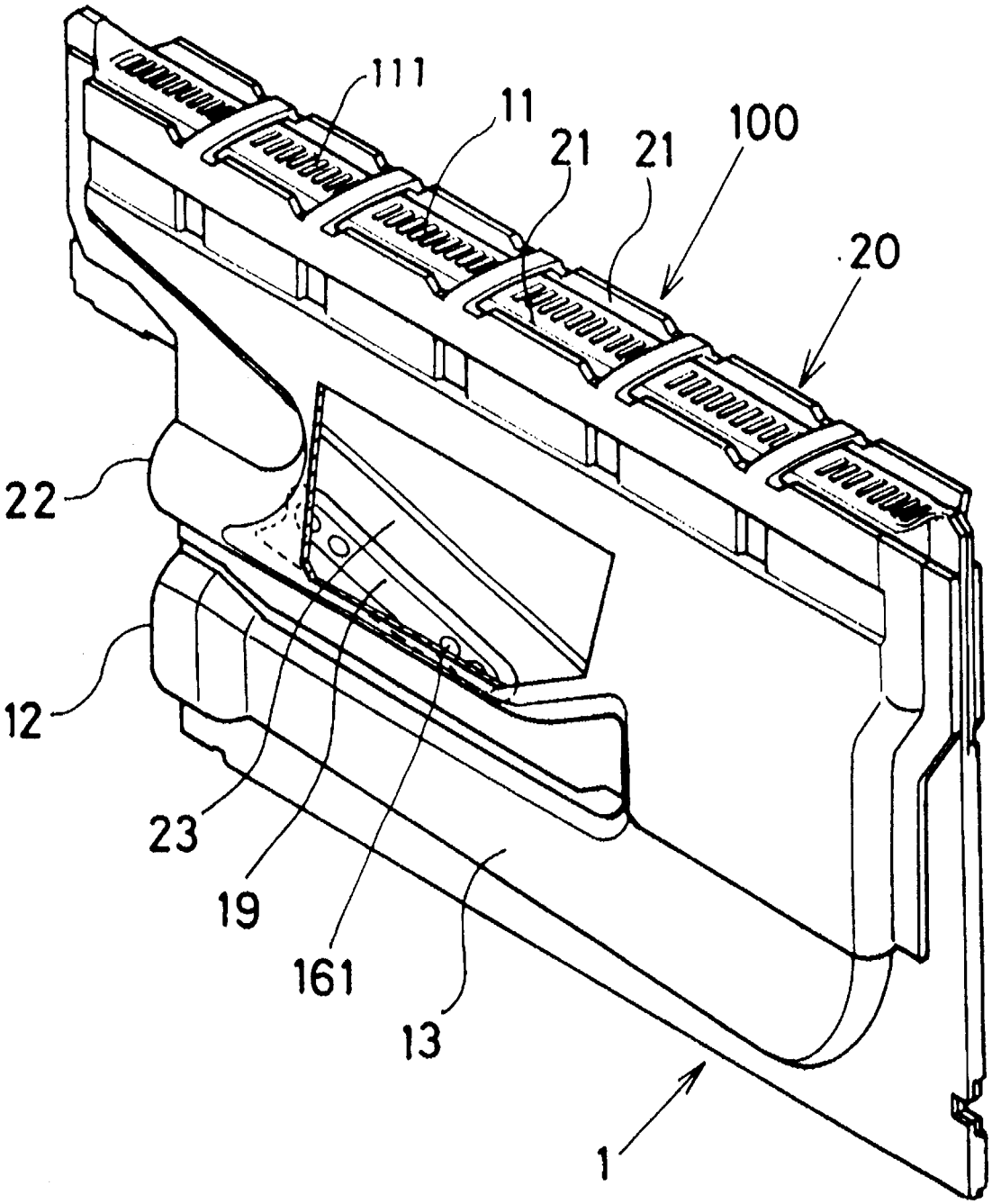
FIG. 7 is a perspective view of the gas burner device according to a fourth embodiment of the invention.
Figure 8:
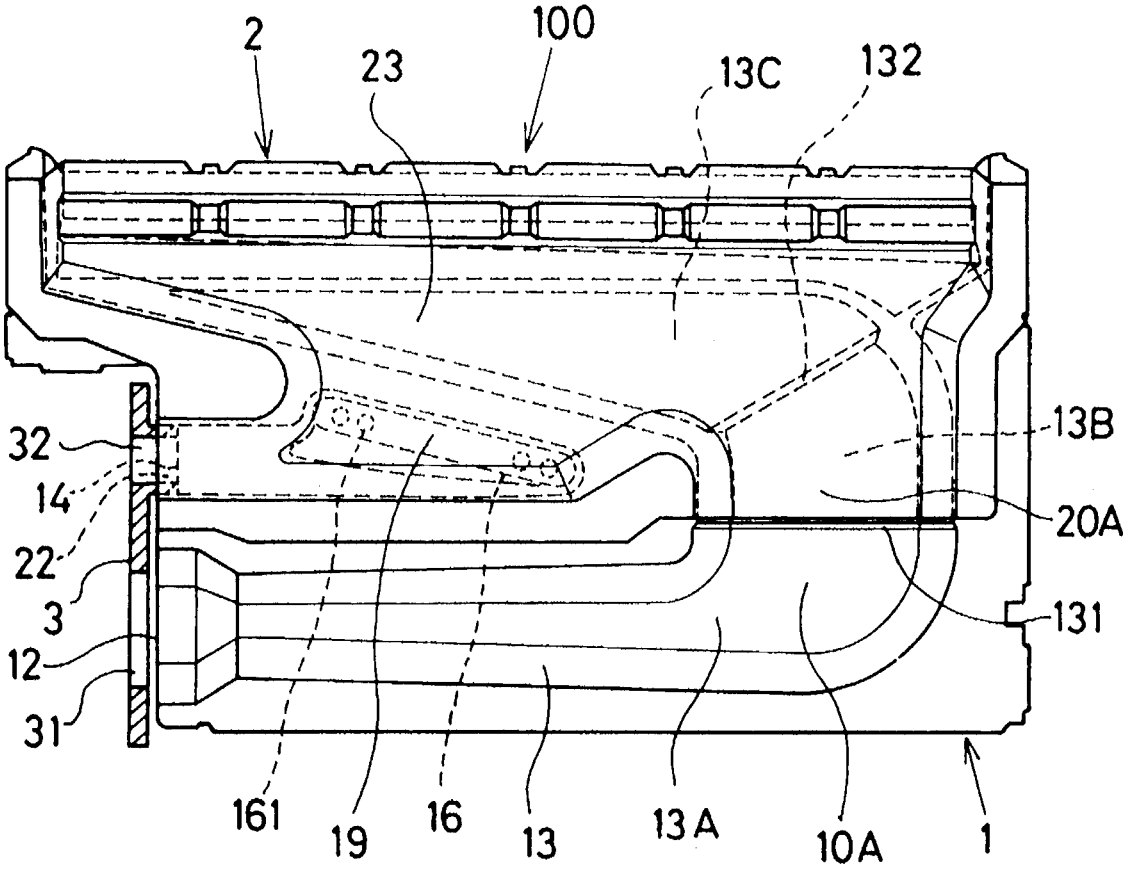
FIG. 8 is a side elevational view of the gas burner device according to the fourth embodiment of the invention.
Figures 9A, 9B, 9C:
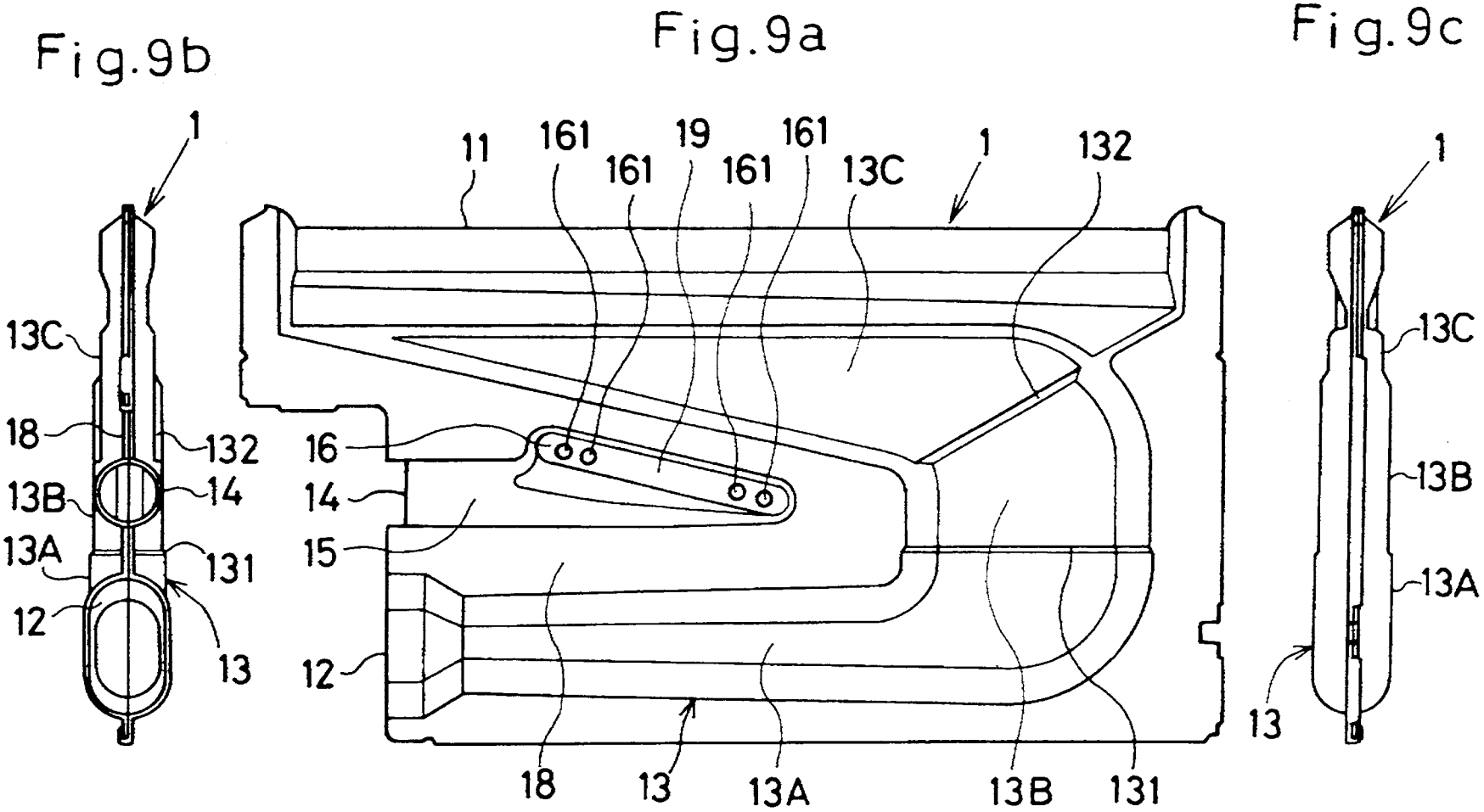
FIG. 9*a* is a side elevational view of the main burner according to the fourth embodiment of the invention.
FIG. 9*b* is a plan view of the main burner according to the fourth embodiment of the invention.
FIG. 9*c* is a rear elevational view of the main burner according to the fourth embodiment of the invention.
Figure 10C:
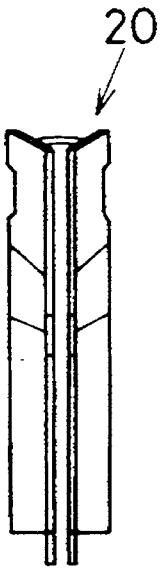
FIG. 10*c* is a rear elevationl view of the cover plate according to the fourth embodiment of the invention.
Figure 10A:
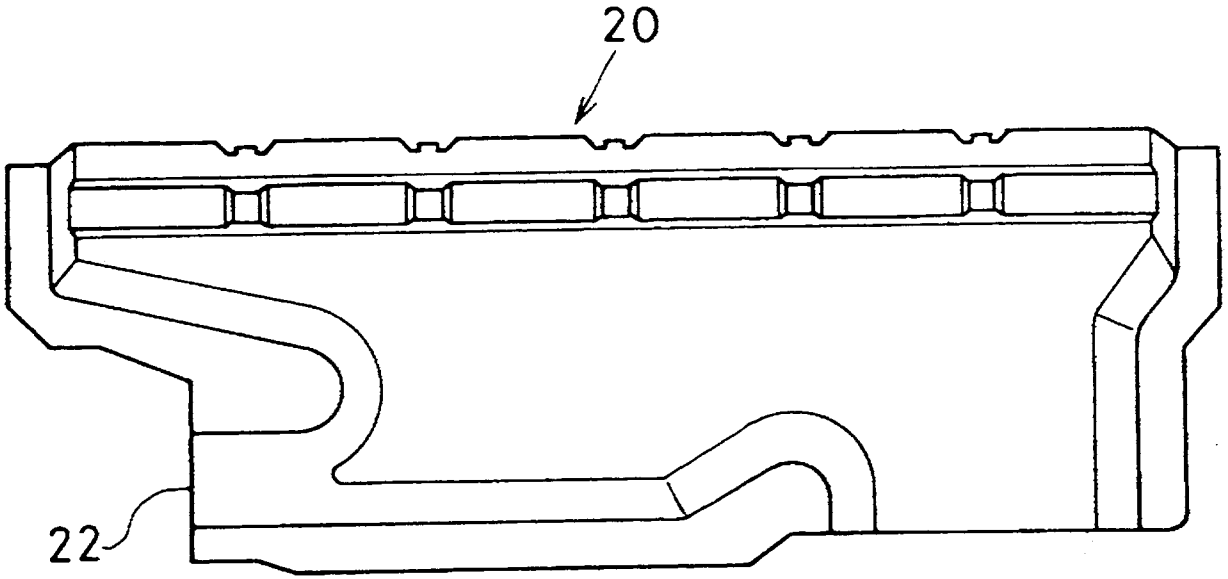
FIG. 10*a* is a side elevational view of a cover plate according to the fourth embodiment of the invention.
Figure 10B:
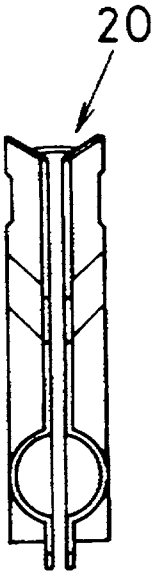
FIG. 10*b* is a plan view of the cover plate according to the fourth embodiment of the invention.

FIGS. 7~10 show a fourth embodiment of the invention in which width of the cover plate 20 is smaller than that of the main burner 1 as apparent when comparing FIGS. 10*a*, 10*b* and 10*c* to FIGS. 9*a*, 8*b* and 9*c*. This makes it possible to manufacture the lower part of the gas burner device 100 into a mono-structure so as to contribute to lightweight and cost-saving. As shown in FIG. 9, the main burner 1 forms the suction hole 12 at one end of the flow path 13, and having an inlet portion 13A horizontally extending from the one end to the other end of the suction hole 12. The main burner 1 further has a middle portion 13B rising up from the other end of the inlet portion 13A and an outlet portion 13C extending extensively from an upper end of the middle portion 13B to communicate with the main fire hole 11.

The middle portion 13B of the flow path 13 is thinned by the thickness of the cover plate 20 via a middle step portion 131 so as to make an surface 20A of the cover plate 20 flush with an surface 10A of the main burner 1 as shown in FIG. 8. This makes it possible to manufacture the gas burner device flat and thin so as to render whole the structure compact with no interference against other objects when assembling the gas burner device. The outlet portion 13C of the flow path 13 is thinned via a slantwise step 132 against the middle portion 13B.

Between an outer wall of the outlet portion 13C and an inner wall of the cover plate 20, the flow path 23 is provided through which the air-fuel mixture is drawn to the sleeve burner 2. The throat portion 15 serves as a cylindrical body which is provided with a non-bulged portion 18 between the inlet portion 13A of the main burner 1 and the outlet portion 13C. The throat portion 15 is somewhat retracted into the suction hole 12 of the main burner 1, while the throat outlet 16 serves as a communication hole, and consisting of axially arranged small holes 161, two of which is symmetrically provided at both ends of a slope 19 which is arranged in the throat outlet 16.

Due to the slantwise step 132 and the axially distributed small holes 161, it is possible to disperse the air-fuel mixture from the throat outlet 16 without heightening the pressure in the flow path 23, thus making it possible to evenly bifurcate the air-fuel mixture into the sleeve fire holes 21, 21. This obviates the necessity of constricting the flow path 23 to evenly bifurcate the air-fuel mixture so as to avoid the increase of the pressure in the flow path 23. This obviate the fear that the air-fuel mixture leaks outside the flow path 23, thus making it possible to enclose only an upper part of the main burner 1 with a vertical width of the cover plate 20.

The suction hole 14 of the sleeve burner 2 is retracted by about 3 mm into the common inlet 22 of the cover plate 20 so as to communicate the common suction hole 22 with the throttle hole 32 of the damper 3 as shown in FIG. 8. This makes it possible to avoid the leakage of the air-fuel mixture between the main burner 1 and the cover plate 20.

It is difficult to evenly supply the air-fuel mixture to both sides of the main fire hole 11 when the air-fuel ratio air-fuel mixture ranges an entire region from a high load burning to a low load burning because of the high flatened degree of the main burner 1. In General, the air-fuel mixture is excessive or short in one of the sides of the main fire hole 11 so as to cause lift of flames and a repeated extinction of flames, thus producing an unfavorable noise.

In order to reduce the noise level in some degree, it is possible to make the main fire hole 11 by the row of slits as shown in FIGS. 1, 7. However, in the case in which the air-rich fuel is used with its air-fuel ratio as about 1.4, and the gas burner device is operated in the extensive range from a minimum calorific power to a maximum calorific power, it may render it difficult to sufficiently prevent the vibration of the flames only by making the main fire hole 11 with the row of slits.

Figure 11A:
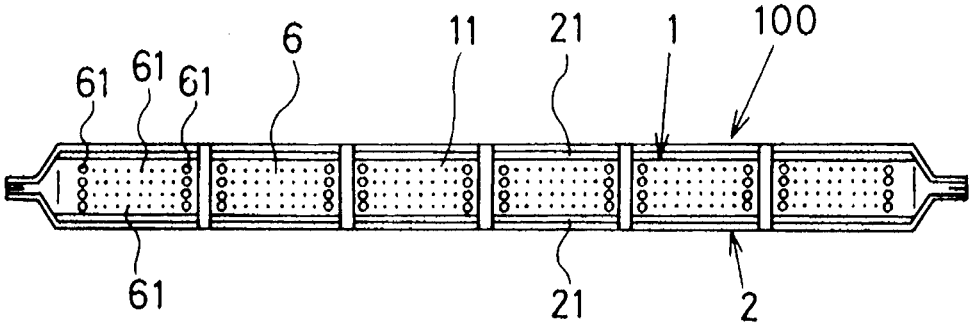
FIG. 11*a* is a plan view of the gas burner device according to a fifth embodiment of the invention.
Figure 11B:
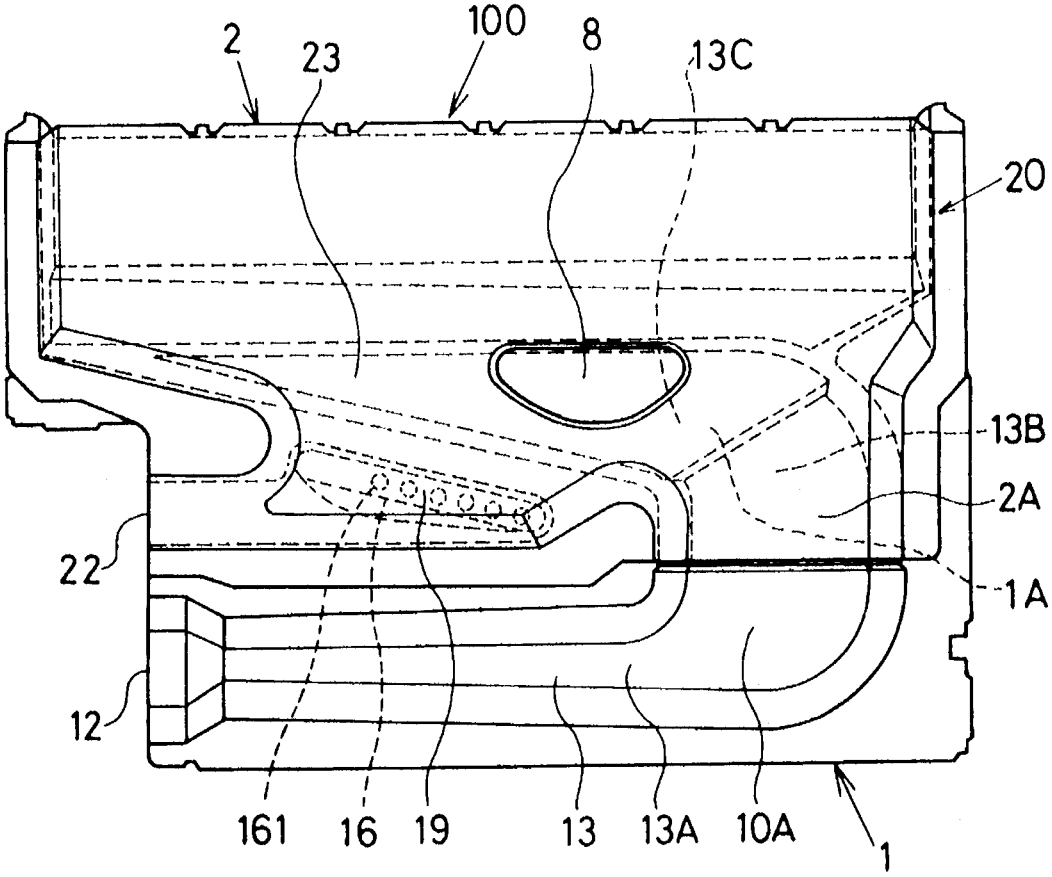
FIG. 11*b* is an elevational view of the cover plate according to the fifth embodiment of the invention.

FIG. 11*a* and 11*b* shows a fifth embodiment of the invention in which the main fire hole 11 consists of a multitude of miniature fire holes 6 extensively distributed on an upper surface of the main burner 1. The miniature fire holes 6 makes it possible to effectively prevent the vibration of the flames on the upper surface of the main burner 1. In order to form the miniature fire holes 6, matrix-like holes 61 are previously made on the metal plate in corresponding to the position of the main fire hole 11. Each of the holes 61 is 0.9 mm in diameter, and arranged at 1.6 mm pitch and four rows in the width direction. It is observed that the holes may be elliptic, and arranged in a staggering pattern. With the provision of the miniature fire holes 6, it is possible to disperse the vibration energy of the flames, thus preventing from disseminating the vibration of the flames one after another so as to reduce the noise level. Among the series of small holes 161 serving as the throad outlet 16, two small holes are omitted which correspond to ones located at the common suction hole 22 in the fourth embodiment of the invention shown in FIG. 8. This is to avoid the insufficient mixing degree of the air-fuel mixture from running in the flow path 23 due to the shortened distance from the common suction hole 22 to the small holes.

Figure 12:
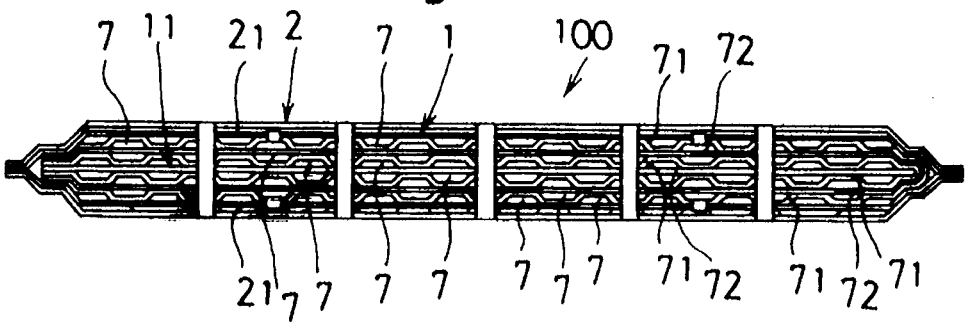
FIG. 12 is a plan view of the gas burner device according to a sixth embodiment of the invention.
Figures 13A, 13B, 13C, 13D:
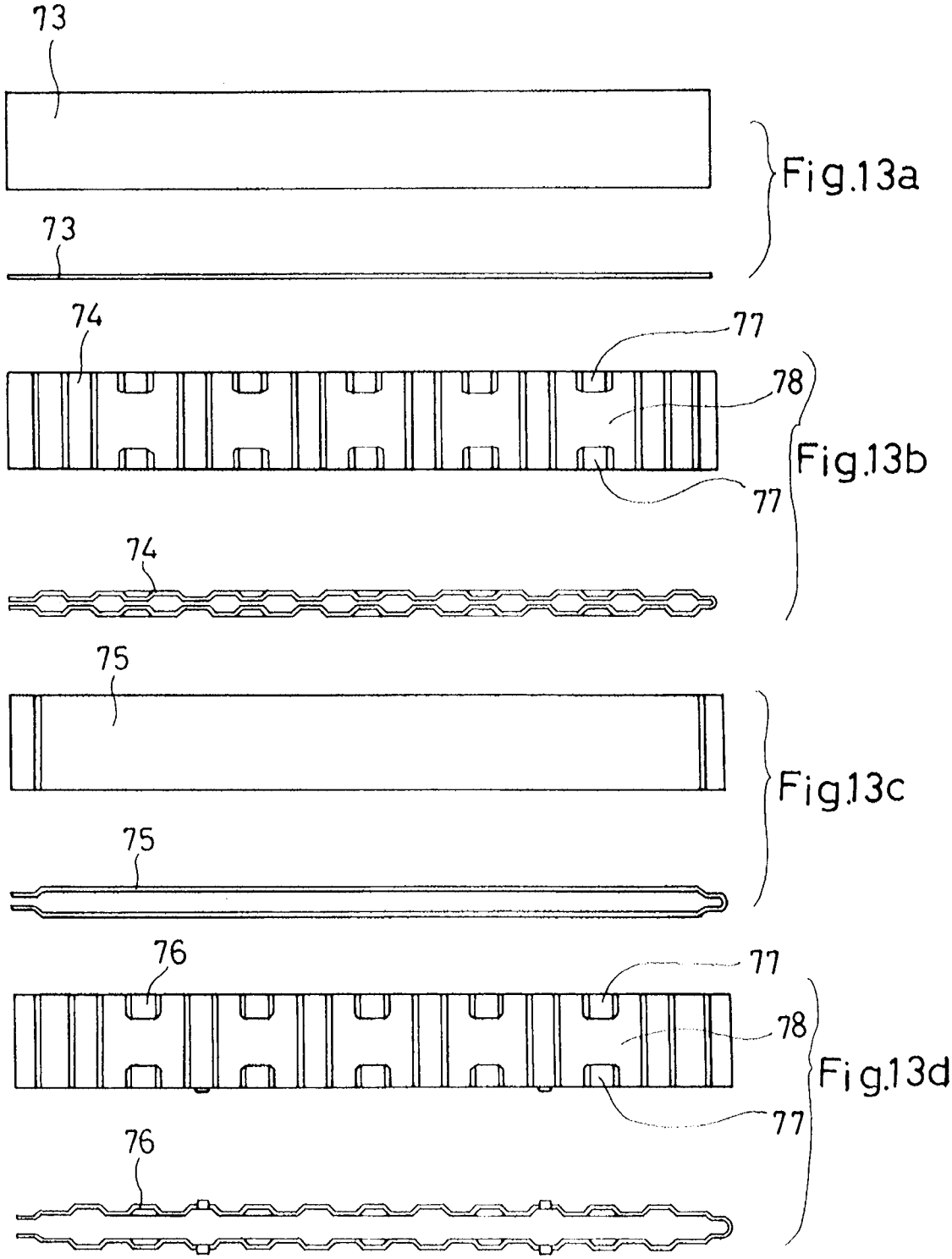
FIGS. 13*a* through 13*d* are views of consisting elements of the main burner for the gas burner device according to the sixth embodiment of the invention.

FIG. 12 shows a sixth embodiment of the invention in which four corrugated metal and three flat metal 22 are alternately laminated to provide a multitude of small fire holes 2. The small fire holes are trapezoidal in section, and arranged in seven rows in the width direction.

FIGS. 13*a* through 13*d* show elements consisting of the small fire holes 7. In FIGS. 13*a* through 13*d*, numeral 73 designates a central flat plate, 74 is a corrugated plate connector which sandwiches the central flat plate 73. Numeral 75 designates an outer plate which is laminated on an outer side of the corrugated plate connector 74. Numeral 76 designates an outer plate which is laminated on an outer side of the outer plate 75. The laminated plates are bonded each other by means of a spot welding, and incorporated into the upper end of the main burner 1 to form the main fire hole 11 as shown in FIG. 12. Compared to the small fire hole 6 of the fifth embodiment of the invention, this structure enables to lengthen the small fire hole 7 so as to appropriately adjust the flow resistance and to rectify into a laminar flow. As shown particularly in FIG. 13*b*, upper and lower portions of the outer plate 75 has a corrugated portion 77, while a middle portion of the outer plate 75 has a flat plate portion 78. The flow path per se is capable of rectifying into the laminar flow. The fire hole 7 of the sixth embodiment has an effect of controlling the flame vibration, but has a tendency to somewhat sacrify the manufacturing cost due to its complicated structure.

Figure 14:
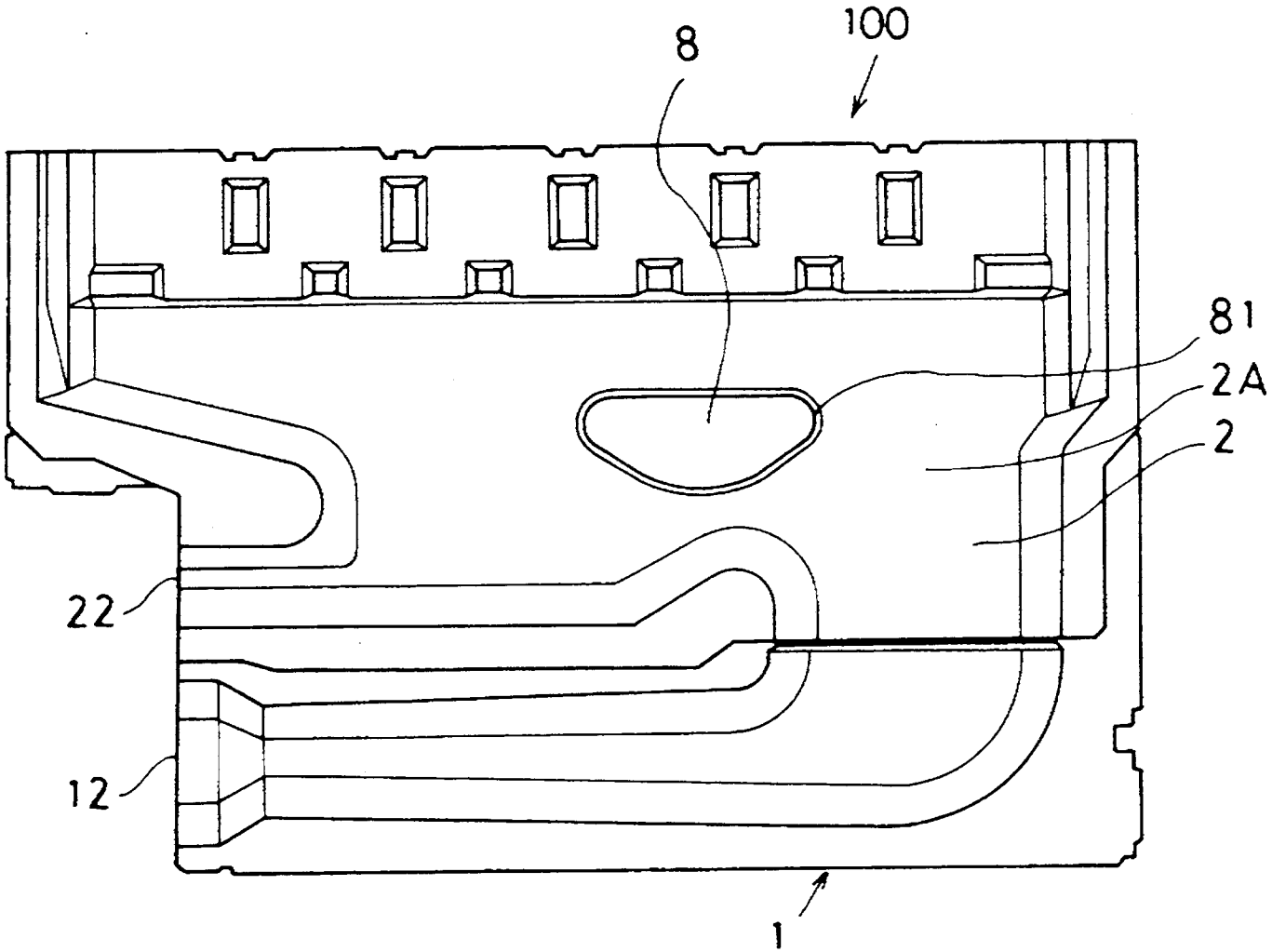
FIG. 14 is a plan view of the gas burner device according to a seventh embodiment of the invention.

FIG. 14 shows a seventh embodiment of the invention in which a baffle portion 8 is provided in the flow path 23 to evenly distribute the air-fuel mixture into the sleeve fire holes 21, 21 in a highly flatened type of sleeve burner. The baffle portion 8 is formed at a central area of the bulged portion 2A of the cover plate 20 in the form of annular ring 81 which is to be engaged with an outer surface of the bulged portion 1A of the main burner 1. The baffle portion 8 makes it possible to evenly supply the air-fuel mixture to the sleeve fire holes 21, 21 so as to substantially reduce the occurrence of back fire and the vibration of the flames which lead to unstable combustion.

Figure 15A:
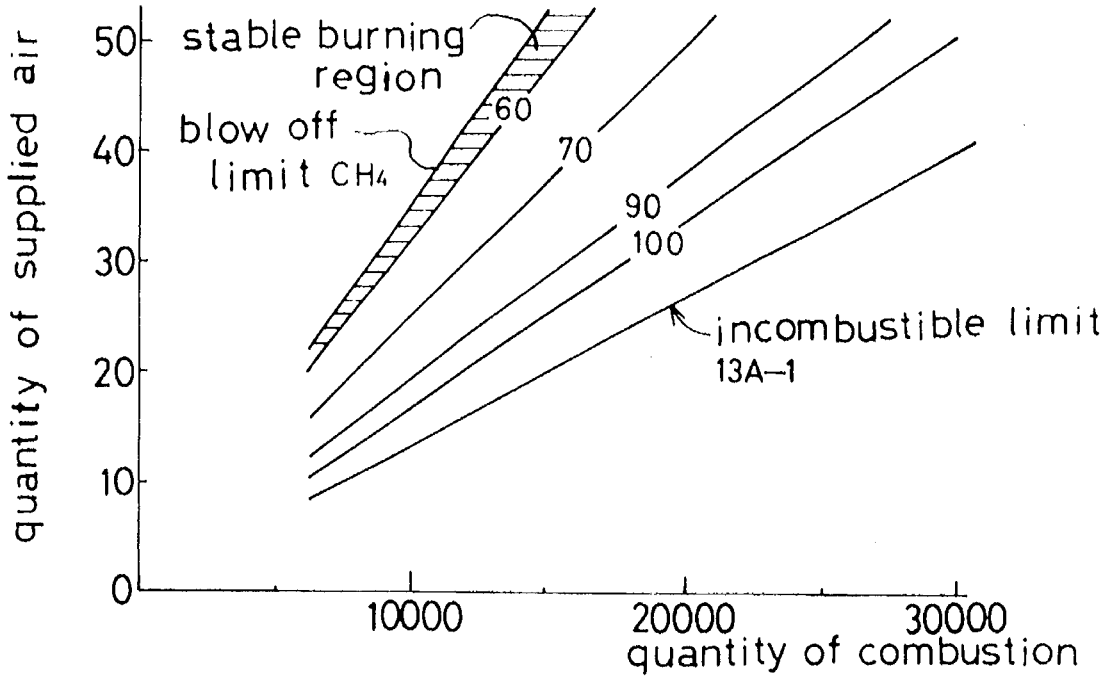
FIGS. 15*a* and 15*b* are graphs indicating a burning stability region.
Figure 15B:
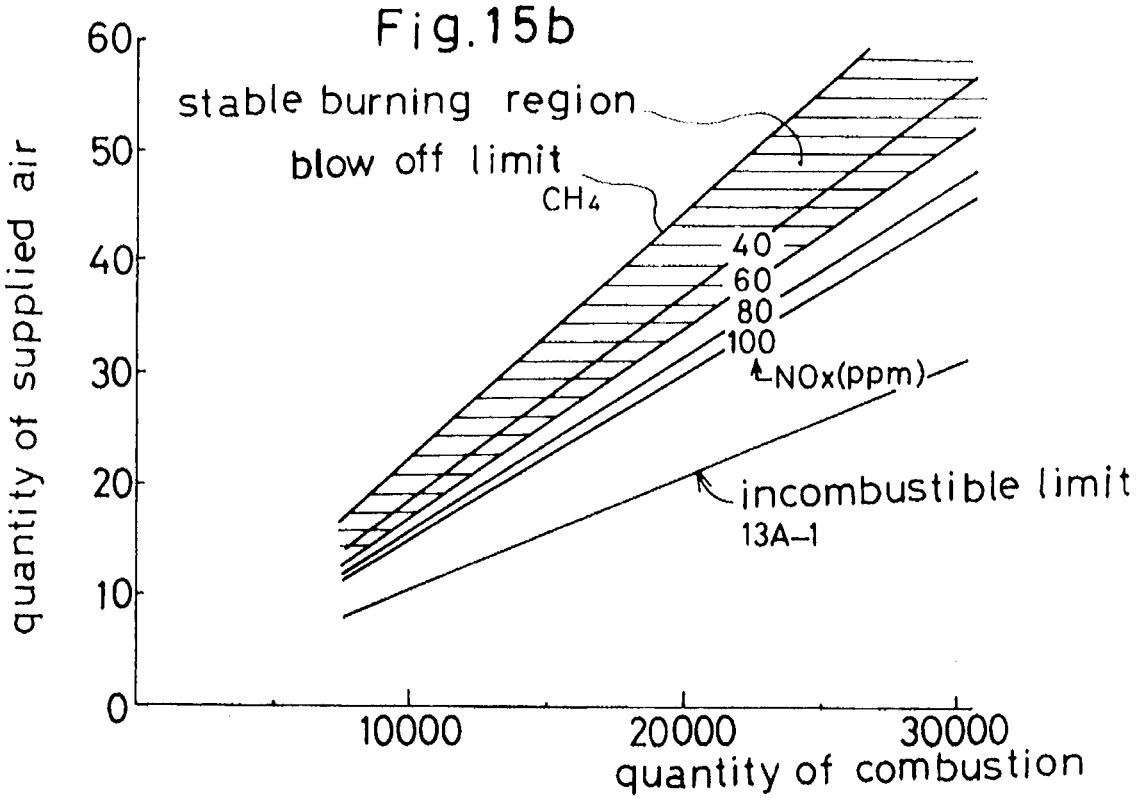

FIG. 15*a* shows a graph indicating a stable burning range when a prior art gas burner device is used within a low emission range of nitric oxide (NOx). FIG. 15*b* shows a graph indicating a stable burning range when the burner device 100 is used within a low emission range (below 60 ppm) of the nitric oxide (NOx). As evidenced by comparing the two graphs, it is possible to carry out the stable burning in an extensive burnig range with the emission of the nitric oxide (NOx) below 60 ppm in the gas burner device 100, as opposed to the prior art gas burner device.

FIGS. 16*a* through 16*i* show a modified form of the seventh embodiment of the invention in which a partition zone 24 is provided between the main fire hole 11 and the sleeve fire hole 21 in the burner device 100. The partition zone 24 makes it possible to vomit a part of the air-fuel mixture in the form of vortex current V through the main fire hole 11. With the establishment of the vortex current V, it is possible to control the air-fuel mixture from the sleeve fire hole 21 under the sleeve fire hole 21 so as to form a flame F2 directed to the main fire hole 11. This makes it possible to prevent the influence of the vibration of the flame F1 on the flame F2 in the sleeve fire hole 21 so as to stabilize the flame F2 to maintain the stable flame F1 with least noise permitted.

A width of the partition zone 24 is 1.3 mm in this embodiment, however it is preferable that the width exceeds 1.0 mm in maintaining the flame and keeping the noise low, and that the width is less than 2.0 mm in stablizing the main fire hole flame by the sleeve fire hole flame.

Figure 16:
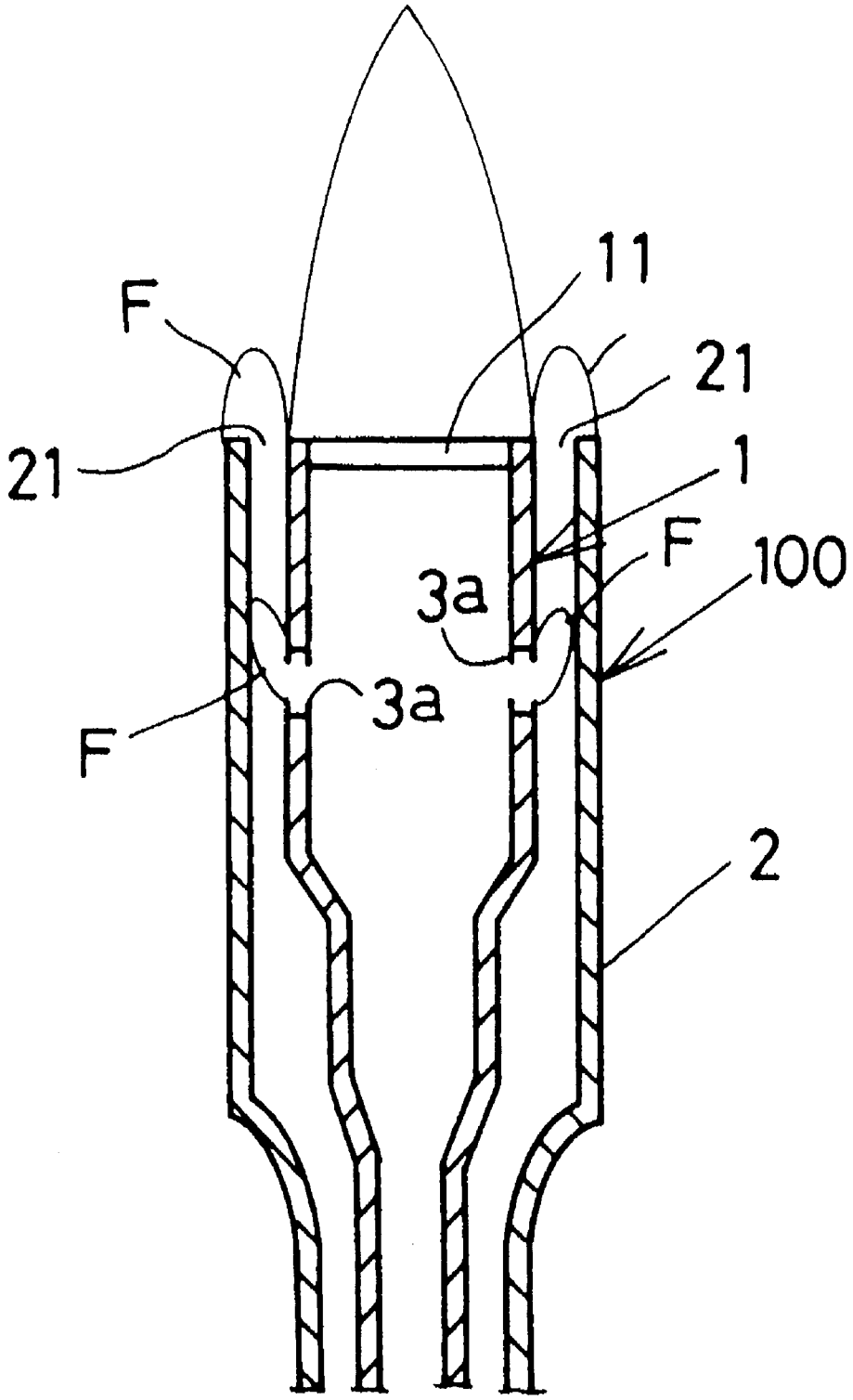
FIG. 16 is a longitudinal cross sectional view of the gas burner device according to an eighth embodiment of the invention.
Figure 16A:
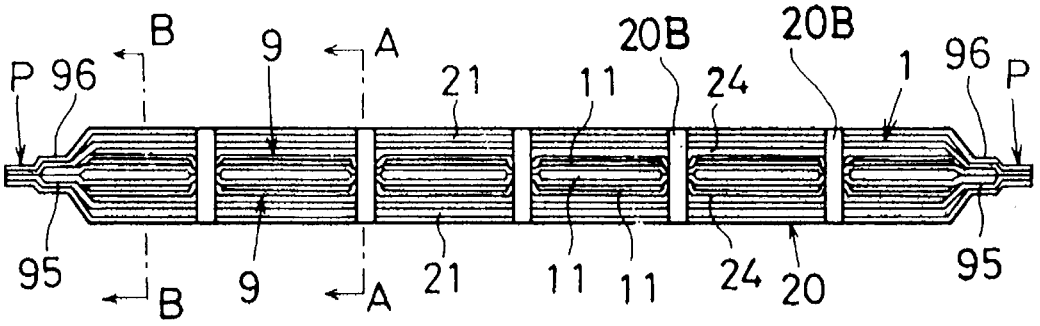
FIG. 16*a* is a plan view of a gas burner device according to a modified form of the seventh embodiment of the invention.
Figure 16B:
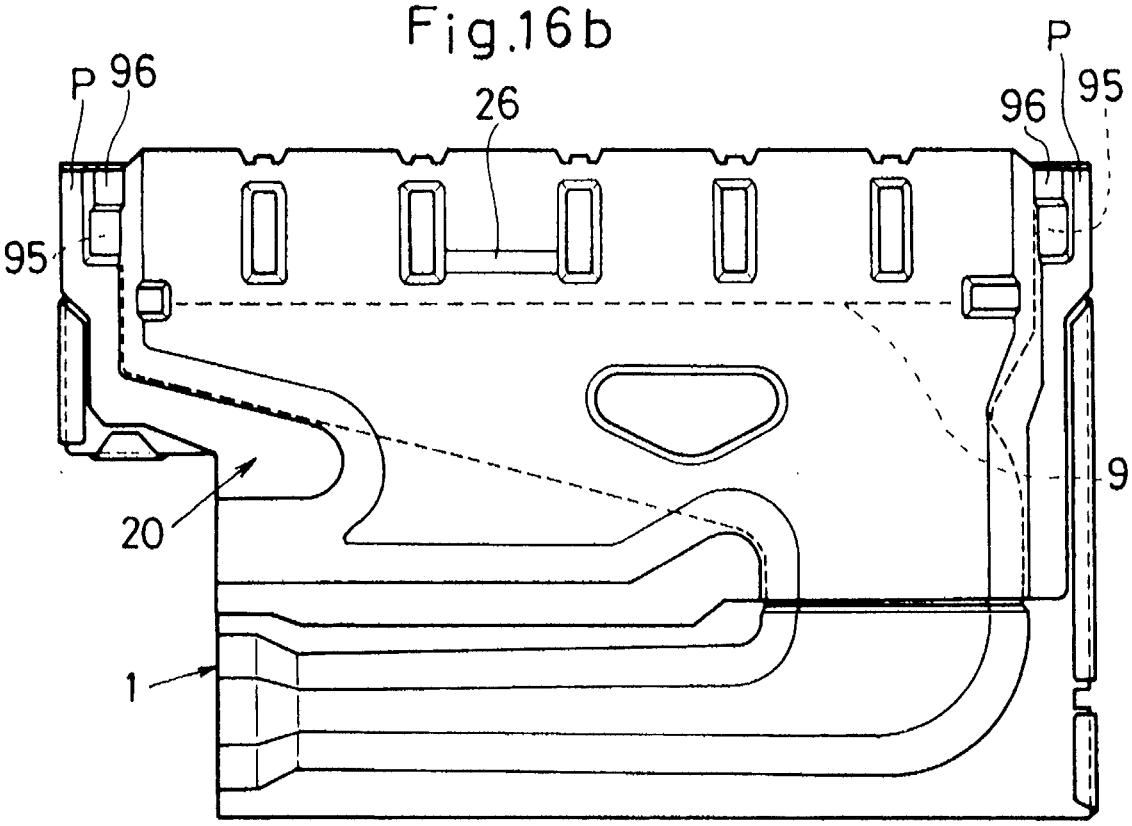
FIG. 16*b* is a front elevational view of a gas burner device according to a modified form of the seventh embodiment of the invention.
Figure 16C:
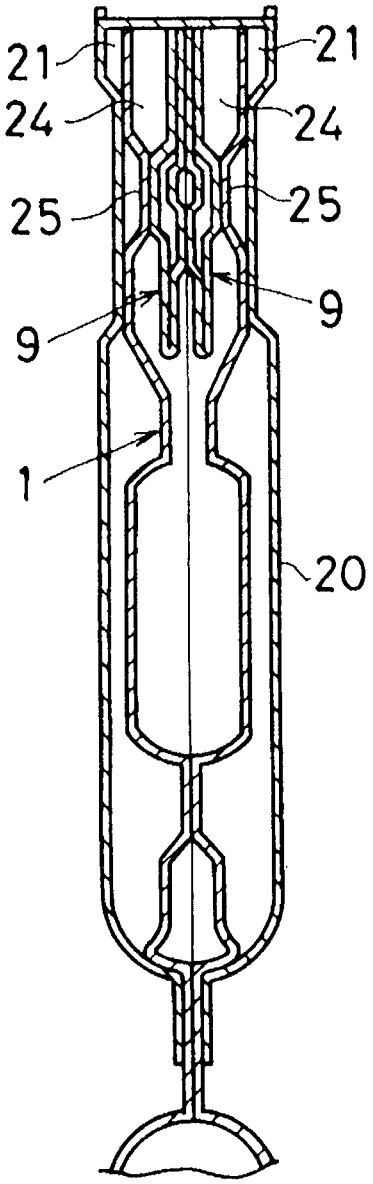
FIG. 16*c* is a longitudinal cross sectional view taken along the line A—A of FIG. 16*a;*
Figure 16D:
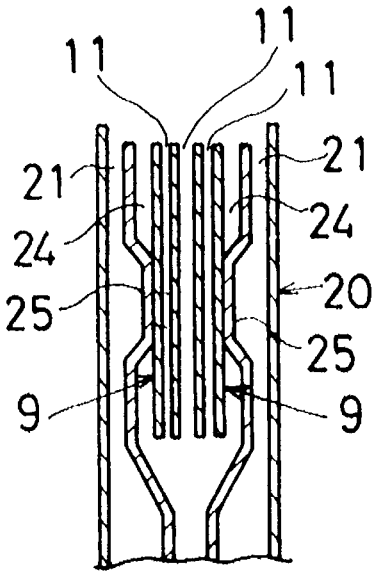
FIG. 16*d* is a longitudinal cross sectional view taken along the line B—B of FIG. 16*a;*
Figure 16E:
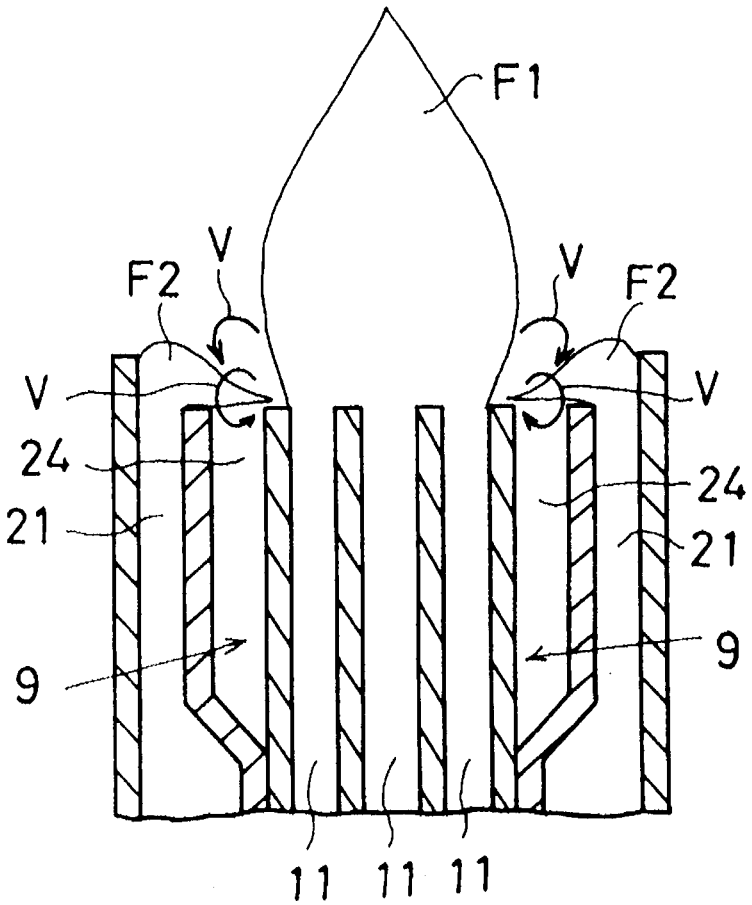
FIG. 16*e* is an enlarged longitudinal cross sectional view of a main fire hole of the gas burner device according to the modified form of the seventh embodiment of the invention.
Figure 16F:
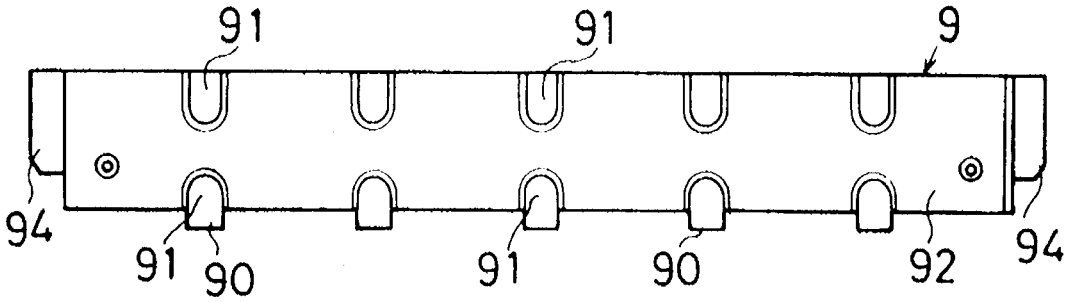
FIG. 16*f* is a front elevational view of the main fire hole of the gas burner device according to the modified form of the seventh embodiment of the invention.
Figure 16G:
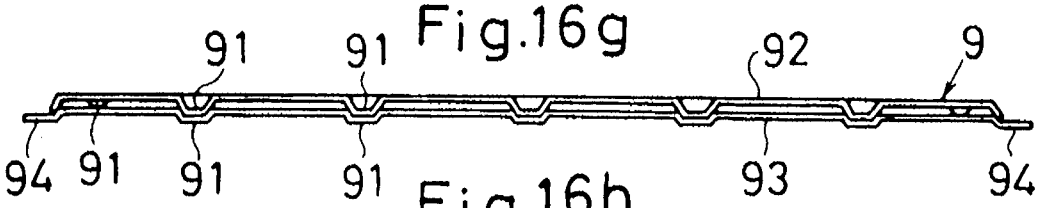
FIG. 16*g* is a plan view of the main fire hole of the gas burner device according to the modified form of the seventh embodiment of the invention.
Figure 16H:
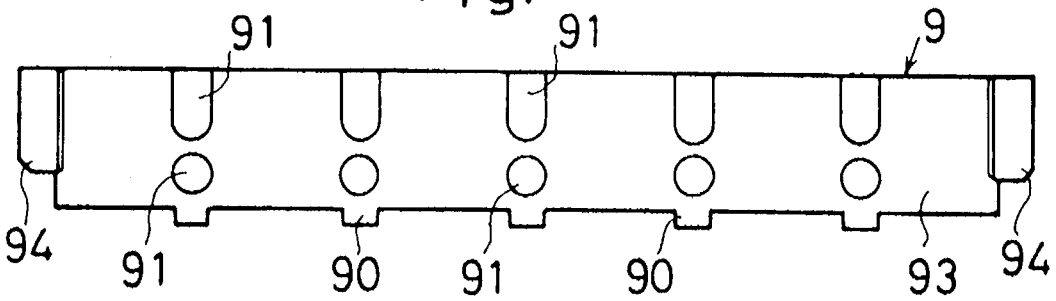
FIG. 16*h* is a rear elevational view of the main fire hole of the gas burner device according to the modified form of the seventh embodiment of the invention.
Figure 16I:
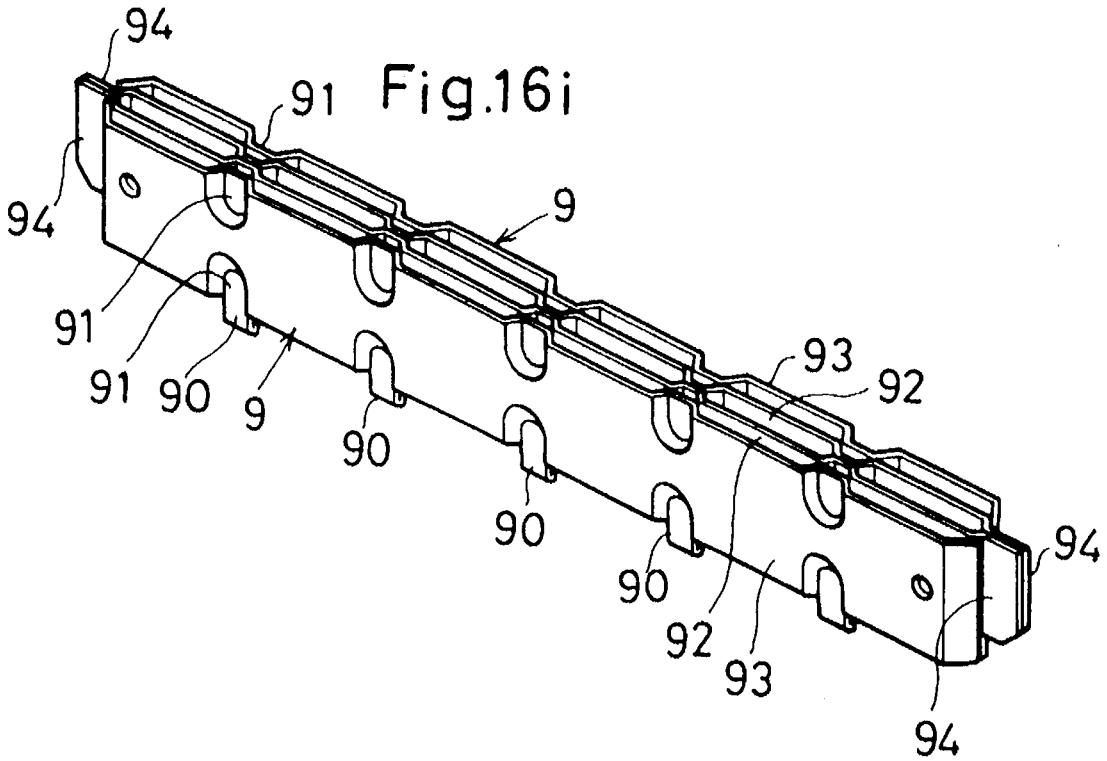
FIG. 16*i* is a perspective view of the main fire hole of the gas burner device according to the modified form of the seventh embodiment of the invention.

A shown in FIGS. 16*c*, 16*d*, the partition zone 24 is provided by forming lateral bulged lines 25 inward the upper portion of the both side of the main burner 1. Between the bulged lines 25, two ribbon metals 9, 9 are interposed. By using the same ribbon metals, it is possible to advantageously reduce the number of parts. Each of the ribbon metals 9, 9 is made by laminating metal sheets 92, 93 which have a lug 91 perpendicular to an outer surface of the metal sheets 92, 93, and used by laminating the two set of the ribbon metals as shown in FIG. 16*i*.

The ribbon metal 9 is made by punching a blank sheet metal, and providing the lug 9 by means of bulging procedure, and bent inward to overlap the half pieces each other. A lower edge of the ribbon metal 9 includes the outer sash metal sheet 92 having five connectors 90 in correspondence to the lug 91 bulged inwardly, and including the inner sash metal sheet 93 having the lug 91 corresponding to the connectors 90 and projection plates 94, 94 at both sides of the metal sheet 93. A pair of the ribbon metals 9, 9 is interfit to an upper portion of the main burner 1 with inner walls of the inner sash metal sheets 93 engaged each other.

The partition zone 24 is formed as a blind space by engaging an inner wall of the bulged line 25 with an outer side of the outer sash metal sheet 92. The main fire hole 11 includes a space between the outer and inner sash metal sheets 92, 93 provided by the spacer lug 91, and a space provided between the two inner sash metal sheets 93, 93.

At both ends of the upper main burner 1, tightly holding gaps 95, 95 are provided in which the laminated projection plates 94, 94 are placed. At both ends of the cover plate 20, tightly holding gaps 96, 96 are provided in a manner to circumscribe the tightly holding gaps 95, 95. At both side of the cover plate 20, a bulged portion 26 is appropriately provided to even the flow distribution of the air-fuel mixture which is supplied to the sleeve fire holes 21, 21. Upon placing the ribbon metal 9 in the main fire hole 11, the projection plates 94, 94 are interposed between the tightly holding gaps 95, 95, and the upper end of the ribbon metal 9 engages with a bridge 20B provided at both upper ends of the cover plate 20.

As described as above, the projection plates 94, 94 are sandwiched by the tightly holding gaps 95, 95 by welding the upper ends P, P of the main burner 1, and the outer and inner sash metal sheets 92, 93 are interposed between the bulged lines 25, 25 of the main burner 1. Further, both sides of the main burner 1 are interposed between the side walls of the cover plate 20, and the two ribbon metals 9, 9 are fixedly placed longitudinally by the connector 90 of the cover plate 20 and a bottom of the tightly holding gaps 95, 95. This makes it possible to eliminate the necessity of spot-welding at an intermediate point of main burner 1 and the cover plate 20, and thus obviating an occurrence of the thermal strain due to the spot weld. This makes it possible to evenly maintain the space between the walls all through the width dimension, making it possible to readily assemble the burner device with an accurate dimension.

Figure 16J:
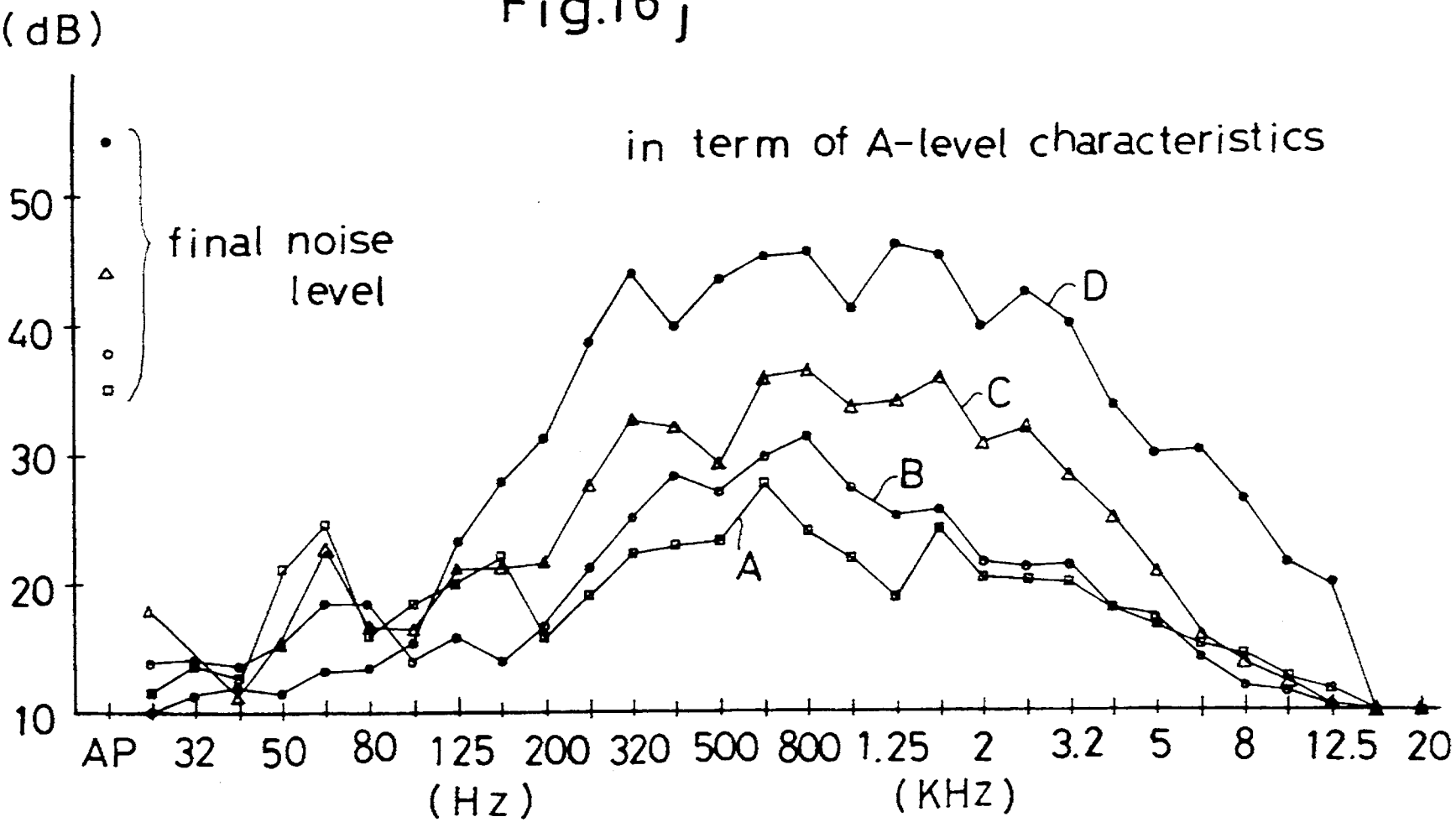
FIG. 16*j* is a graph showing noise level emitted form the gas burner device.

FIG. 16*j* shows a graph illustrating the noise measurement data of the gas burner device in the term of A-level characteristics according the invention. Notation A represents a characteristic curve when only burner fan is operated without burning the fuel-gas mixture. Notation B represents a characteristic curve when the gas burner device used according to the modified form of the seventh embodiment of the invention. Notation C represents a characteristic curve when the gas burner device used according to the fifth embodiment of the invention. Notation D represents a characteristic curve when the gas burner device used according to the first embodiment of the invention. The graph of FIG. 16*j* indicates that the final noise level of the characteristic curves A, B, C and D are in turn 35 dB, 38 dB, 44 dB and 54 dB. This shows how the noise level is reduced according to the modified form of the seventh embodiment of the invention.

FIG. 16 shows an eighth embodiment of the invention in which a communication passage 3*a* is provided in the form of a series of slits which communicates a flow path of the main burner 1 with the sleeve fire holes 21, 21 of the sleeve burner 2.

By way of illustration, a quantity of combustion in the main burner 1 is adapted to be twice that of the sleeve burner 2. The large amount of the fuel gas supplied by the nozzle 41 meets a large amount of the primary air to swiftly runs into the main burner 1 via the suction hole 12. This makes an inner pressure of the main burner 1 higher than that of the sleeve burner 2. The small amount of the fuel gas supplied by the nozzle 41 meets a small amount of the primary air to slowly runs into to the sleeve burner 2 via the suction hole 22, and bifurcated into the sleeve fire holes 21, 21. This makes an inner pressure of the sleeve burner 2 lower than that of the main burner 1. It is noted that the lower pressure is maintained by determining an open area of the sleeve fire hole 21 larger than that of the main fire hole In the main burner 1, the lean air-fuel mixture is used with its air ratio as 1.4. In the sleeve burner 2, the fuel-rich mixture is used whose air ratio is beyond the burnable limit such as below 0.6 when methane is employed as a fuel gas. The air-rich fuel is partly supplied to the sleeve burner 2 via the communication passage 3*a* because of the pressure difference between the main burner 1 and the sleeve burner 2. For this reason, the air-fuel mixture existing above the communication passage 3*a* has an ignitable and burnable air-fuel ratio, thus effectively preventing the back fire from reaching to the nozzle 41.

Upon using the water heater apparatus, the quantity of combustion changes from 3000 up to 30000 calorie according to the required temperatures of the hot water. With the decrease of the quantity of combustion, the flowing velocity of the air-fuel mixture slows so that the speed of the fuel-rich mixture in the sleeve fire hole 21 is below the disseminating velocity of the flames. In this instance, a flames F penetrate inside the sleeve burner 2 via the sleeve fire hole 21. However, the flames F does not penetrate deep into the sleeve burner 2 since the air-fuel mixture below the passage 3*a* has an unignitable air-fuel ratio. With the increase of the quantity of combustion, the air-fuel mixture flows swiftly to divert the flames F back to the sleeve fire hole 21. The open area of the slit-like communication passage 3*a* is 3~4 mm in length and less than 0.5 mm in width. These dimensional arrangement makes it possible to prevent the flames F from penetrating into the main burner 1 via the communication passage 3*a*.

Figure 17A:
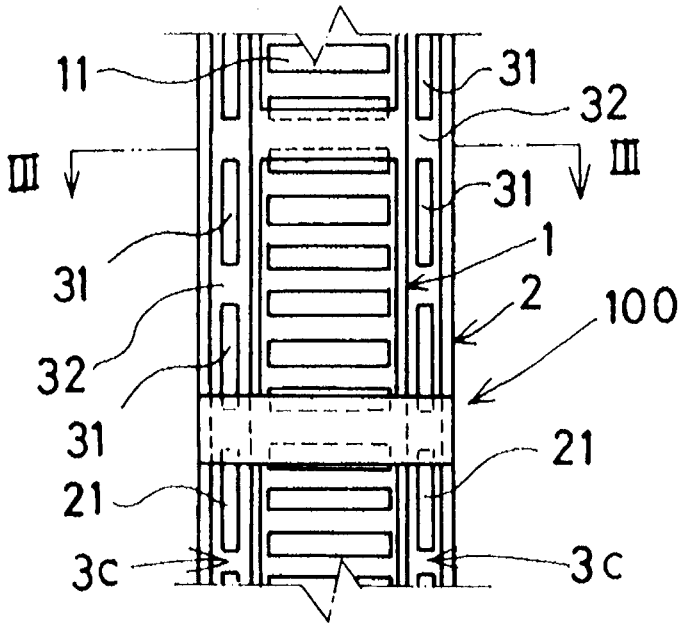
FIG. 17*a* is a plan view of the gas burner device according to a ninth embodiment of the invention.
Figure 17B:
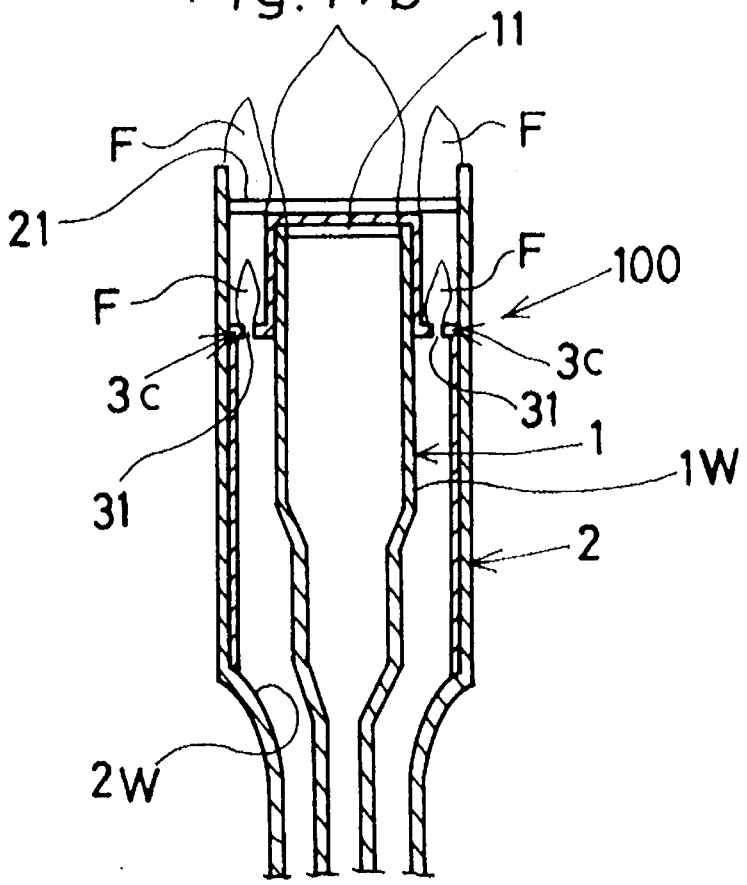
FIG. 17*b* is a longitudinal cross sectional view of the gas burner device taken along the line III—III of FIG. 17*a;*

FIGS. 17*a*, 17*b* show a ninth embodiment of the invention in which the sleeve burner 2 is made by a metal plate. The slit-like sleeve fire holes 21, 21 are provided in a manner to sandwich the main fire hole 11. Within each of the sleeve fire holes 21, 21, the strip plate 32 is provided which has a row of slits 31 to act as stoppable slits 3*c* in order to throttle the sleeve fire holes 21, 21. In this instance, one lateral side of the strip plate 32 is welded to an inner wall 2W of the sleeve burner 2, while the other lateral side of the strip plate 32 is welded to an outer wall 1W of the main burner 1.

The air-fuel mixture supplied by the nozzle 41 meets the primary air to form the air-rich fuel, and swiftly runs inside the main burner 1 via the suction hole 12 so as to lean burn at the main burner 1 as shown in FIG. 17*b*. The air-fuel mixture supplied by the nozzle 41 meets the primary air to form the fuel-rich mixture, and slowly runs inside the sleeve burner 2 via the common suction hole 22 so as to burn at the main burner 1 as shown in FIG. 17*b*. At the stopable slit 3*c* which is somewhat located at the upper reach of the sleeve fire holes 21, 21, the air-fuel mixture is temporarily quickened. However, the air-fuel mixture flows slowly at the lower reach of the sleeve fire holes 21, 21 so as to form stable flames on the sleeve fire holes 21, 21.

With the provision of the common suction hole 22, it is possible to substantially maintain a constant air-fuel ratio of the mixture running through the sleeve fire holes 21, 21 irrespective of variations caused from assembling processes and the opening adjustment of the suction hole.

In the main burner 1, the lean air-fuel mixture is used with its air ratio as 1.4 in order to lean burn on the main burner 1. In the sleeve burner 2, the fuel-rich mixture is used whose air ratio is 0.8 so as to burn on the sleeve burner 2. The uncombustible fuel gas in the fuel-rich mixture meets the excess air in the lean burning flames to completely burn. This enables to reduce the emission of nitric oxide (NOx) to 40~60 ppm, as opposed to the existing art in which the emission of nitric oxide (NOx) amounts to 120 ppm since the air-fuel mixture is burned with the air ratio initially designed as a constant.

Figure 18:
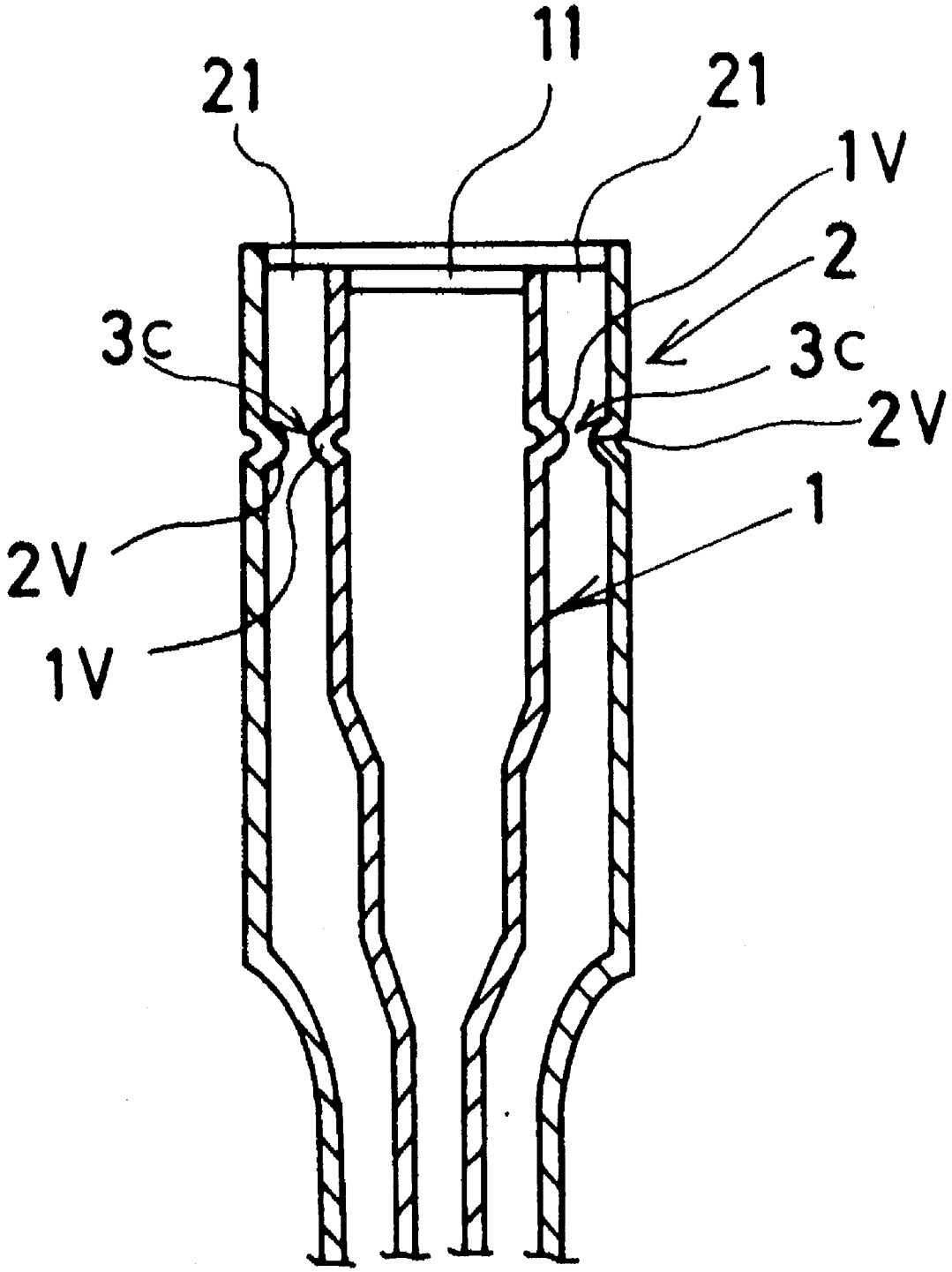
FIG. 18 is a longitudinal cross sectional view of the gas burner device according to a tenth embodiment of the invention.

Upon using the water heater apparatus, the quantity of combustion changes from 3000 up to 30000 calorie according to the required temperatures of the hot water served. With the decrease of the quantity of combustion, the air-fuel mixture flows slowly so that the fuel-rich mixture in the sleeve fire hole 21 runs slower than the flames disseminate. In this instance, the flames F penetrate inside the sleeve burner 2 via the sleeve fire hole 21. However, the flames F does not penetrate deep into the sleeve burner 2 since the air-fuel mixture flows rapidly through the stopable slit 3*c* in addition to the flame extinction effect which a lower wall of the stopable slit 3*c* has. With the increase of the quantity of combustion, the air-fuel mixture rapidly flows so as to divert the flames F back to the sleeve fire hole 21 since the stopable slit 3*c* is located within the sleeve fire hole 21. It is noted that a width of the stopable slit 3*c* may be preferably less than 0.5 mm with the back fire limit taken into consideration. It is also noted that the stopable slit may be in the form of a series of tiny holes which has a diameter less than 1.0 mm. It is observed that opposing ribs 1V, 2V may be provided on each of the outer wall 1W of the main burner 1 and an inner wall 2W of the sleeve burner 2 so as to form the stopable slit 3*c* between the ribs 1V, 2V as shown in FIG. 18.

Figure 19A:
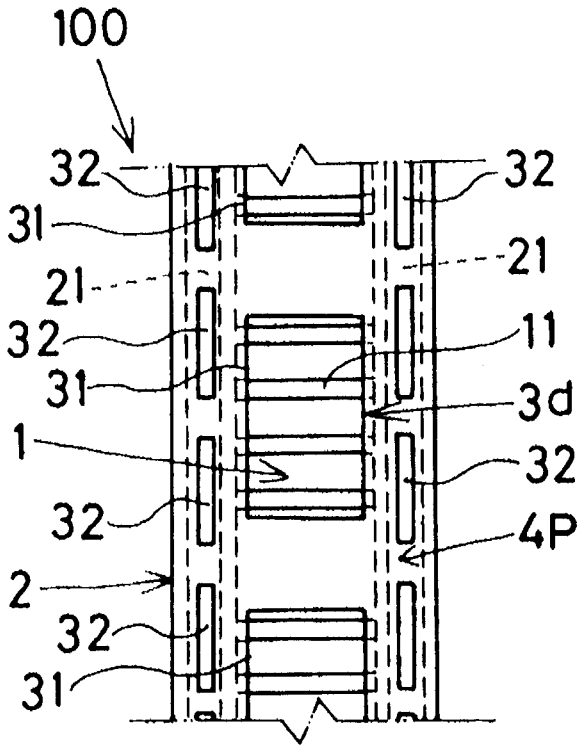
FIG. 19*a* is a longitudinal cross sectional view of the gas burner device according to an eleventh embodiment of the invention.
Figure 19B:
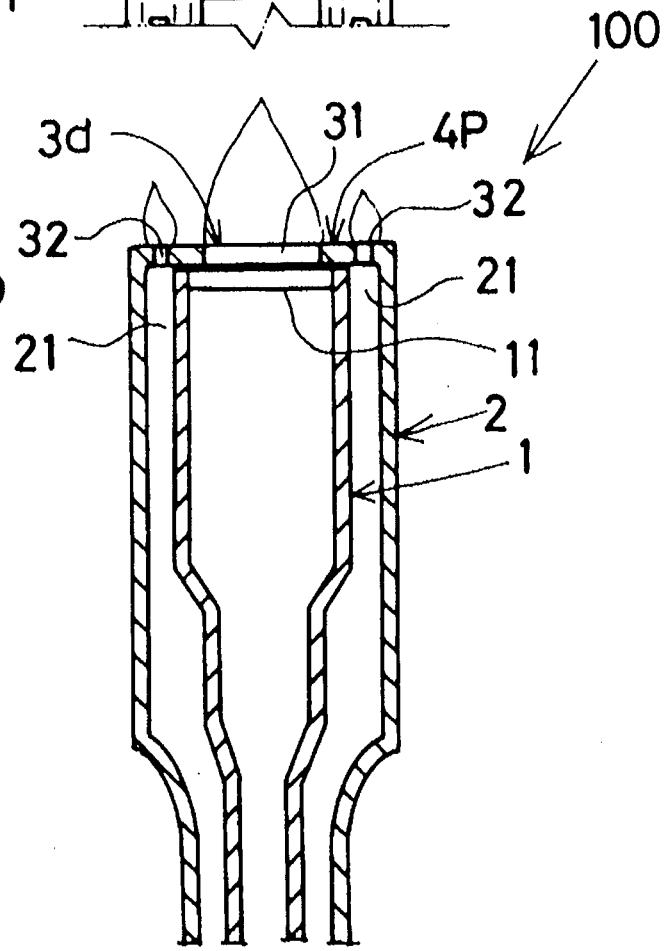
FIG. 19*b* is a plan of the gas burner device according to the eleventh embodiment of the invention.

FIGS. 19*a*, 19*b* show an eleventh embodiment of the invention in which a lid plate 4P is provided which is integrally extended from an upper end of the sleeve burner 2. The lid plate 4P is inturned to cover the main fire hole 11 and the sleeve fire holes 21, 21. The lid plate 4P has a window 3*d* consisting of rectangular blanks 31 and a series of flame holes 32, 32. Each of the rectangular blanks 31 corresponds to three of the slit-like main fire holes 11, while each of the flame holes 32 meets the corresponding sleeve fire holes 21 to narrow their open area. Each of the flame holes 32 is 3~4 mm in length and less than 0.5 mm in width. With the help of the flame extinction effect caused by an inner wall of the lid plat 4P, the above dimensional arrangement makes it possible to effectively prevent the flames from disseminating inside the sleeve burner 2.

The air-fuel mixture supplied by the nozzle 41 meets the primary air to flow into the flow path 13 via the suction hole 12 to burn on the main fire hole 11 as shown in FIG. 19*b*. The air-fuel mixture supplied by the nozzle 41 meets the primary air to flow into the flow path 23 via the common suction hole 22 to burn on the flame holes 32.

In so doing, the lean air-fuel mixture is used with its air ratio as 1.4 in the main burner 1. In the sleeve burner 2, the fuel-rich mixture is used whose air ratio is less than 0.5. This arrangement of the air ratios makes it possible to reduce the emission of nitric oxide (NOx) to 40~60 ppm, as opposed to the existing art in which the emission of nitric oxide (NOx) amounts to 120 ppm since the fuel-air mixture is used with a constant stoichiometric air ratio as 1.

Upon using the water heater apparatus, the quantity of combustion changes from 3000 up to 30000 calorie according to the required temperatures of the hot water. With the decrease of the quantity of combustion, it is feared that the air-fuel mixture flows slowly so that the velocity of the fuel-rich mixture in the sleeve fire hole 21 is below the disseminating velocity of the flames. However, the sleeve fire hole 21 is narrowed by the lid plate 4P such a degree as to prevent the occurrence of the back fire. This makes it possible to maintain the velocity of the fuel-rich mixture below the disseminating velocity of the flames so as to block flames from penetrating deep into the sleeve burner 2.

Figure 20A:
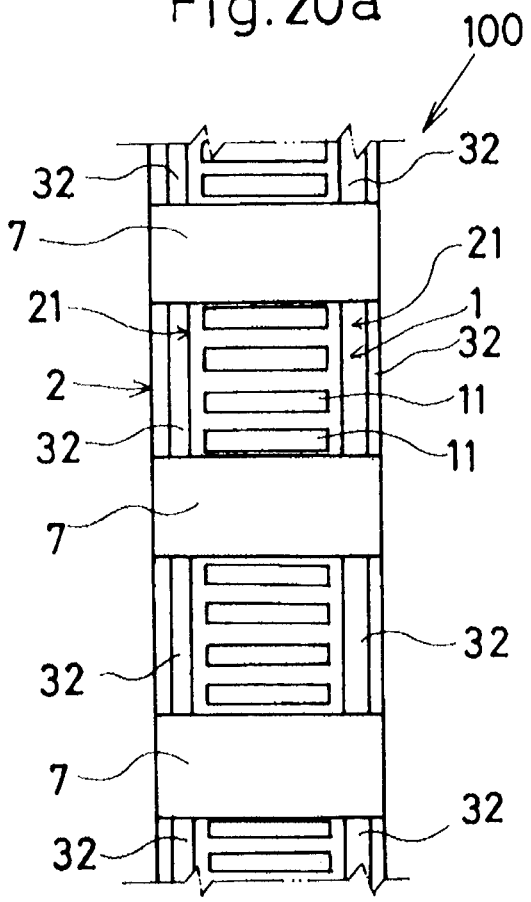
FIG. 20*a* is a longitudinal cross sectional view of the gas burner device according to a twelfth embodiment of the invention.
Figure 20B:
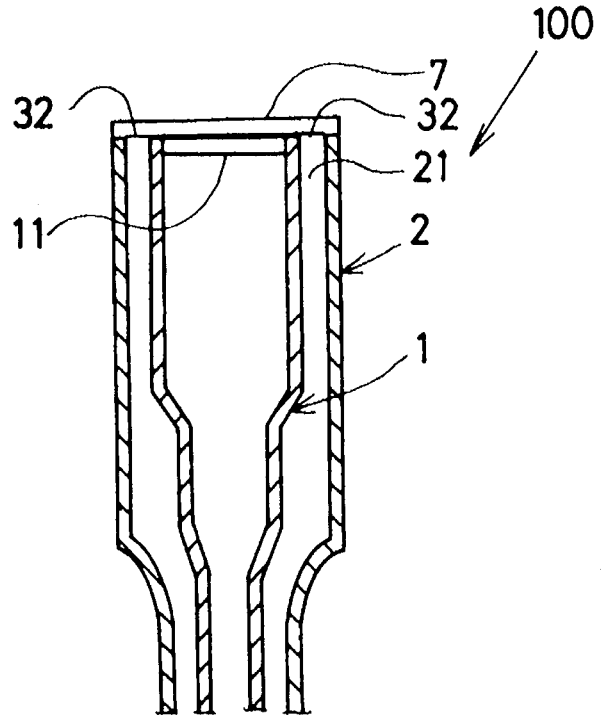
FIG. 20*b* is a plan of the gas burner device according to the twelfth embodiment of the invention.

FIGS. 20*a*, 20*b* show a twelfth embodiment of the invention in which a multitude of bridge plates 71 are provided instead of the lid plate 4P. Each of the bridge plates 71 partially covers the sleeve fire hole 21, and at the same time, dividing the sleeve fire hole 21 into a series of flame holes 32. In this instance, at least five bridge plates 71 are placed at regular intervals. Each of the bridge plates 71 covers the sleeve fire hole 21 such a degree to prevent the occurrence of the back fire.

Figure 21A:
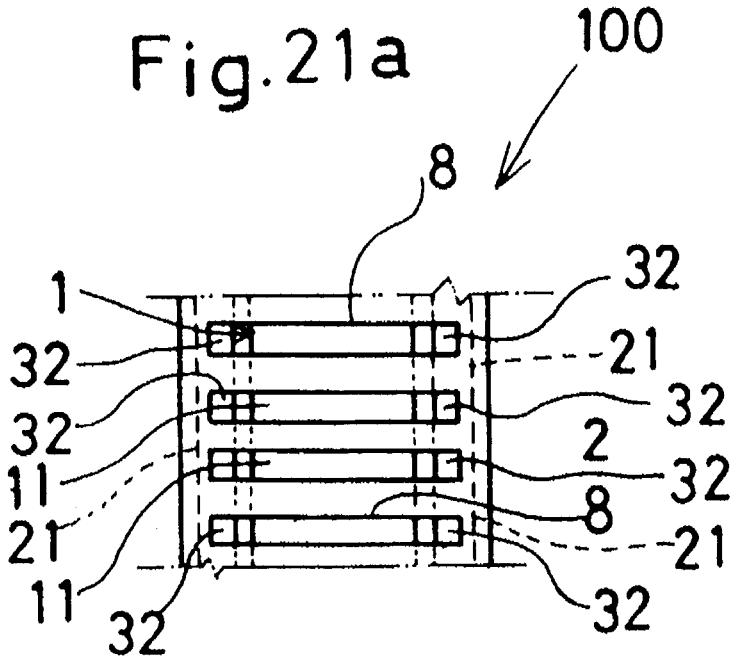
FIG. 21*a* is a longitudinal cross sectional view of the gas burner device according to a thirteenth embodiment of the invention.
Figure 21B:
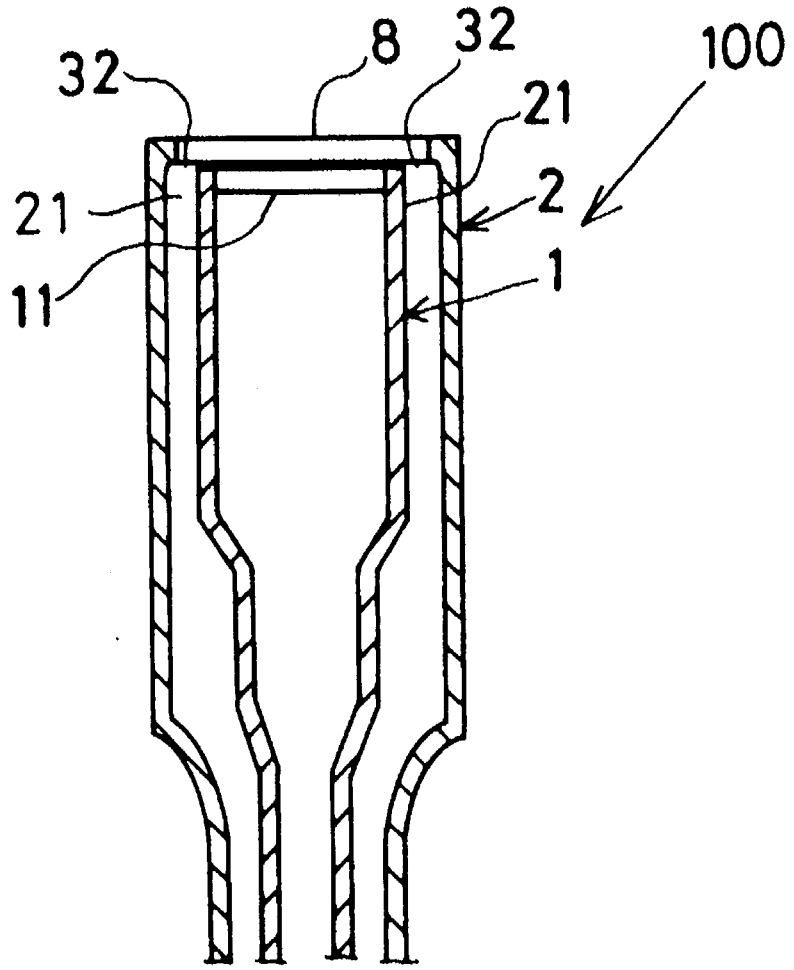
FIG. 21*b* is a plan of the gas burner device according to the thirteenth embodiment of the invention.

FIGS. 21*a*, 21*b* show a thirteenth embodiment of the invention in which the lid plate 4P has a multitude of slits 8 provided across the main fire holes 11 of the main burner 1. Both ends of each slit 8 partially overlap the sleeve fire hole 21 to form the flame holes 32.

It is observed that the flow path 13 may be connected to the main fire hole 11, while the flow path 13 may be connected to the sleeve fire hole 21. The outlet 16 of the flow path 13 may be made by cutting the metal plate at the time of pressing the metal plate.

While the invention has been described with reference to the specific embodiments, it is understood that this description is not to be construed in a limiting sense in as much as various modifications and additions to the specific embodiments may be made by skilled artisan without departing from the spirit and scope of the invention.

What is claimed is:

1. A burner device in which a main burner forms a flat main fire hole to burn an air-rich fuel, and a sleeve burner is provided to form a sleeve fire hole at both sides of the main burner so as to burn a fuel-rich mixture wherein;

the sleeve burner defines a plurality of rectangular blanks and small holes at both sides of the rectangular blanks to provide the sleeve fire holes at a center of a metal plate, and a bulged portion is symmetrically provided at opposed portions of the metal plate, and a bent portion is defined at a center line of the metal plate so as to form a cover plate which encloses the main burner, a part of the metal plate in which the small holes are provided serving as a lid plate which partly covers the sleeve fire hole.

2. A burner device in which a main burner forms a flat main fire hole to burn an air-rich fuel, and a sleeve burner is provided to form a sleeve fire hole at both sides of the main burner so as to burn a fuel-rich mixture, said device comprising:

a plurality of rectangular blanks formed the sleeve burner and small holes formed at both sides of the rectangular blanks to provide the sleeve fire holes at a center of a metal plate, and a bulged portion symmetrically provided at opposed portions of the metal plate, and a bent portion formed at a center line of the metal plate so as to form a cover plate which encloses the main burner, a part of the metal plate which bridges between the rectangular blanks serving as a lid plate which partly covers the sleeve fire hole.

3. A gas burner device having a first burner having a first fire hole formed therein and a second burner having a second fire hole formed therein, said second fire hole being disposed around said first fire hole to straddle said first fire hole;

said second burner having a common suction hole through which a fuel gas and primary air are supplied to the second fire hole independent of fuel gas and primary air supplied to the first burner;

wherein the first fire hole comprises a multitude of arrayed holes formed by laminating two opposed ribbon-shaped metals which have lugs projected substantially perpendicular to an outer surface of the ribbon-shaped metals, both ends of the ribbon-shaped metals are clamped in a gap provided at both corners of the first fire hole of the first burner, and each upper end of the ribbon-shaped metals engages with a bridge provided at the second fire hole of the second burner to be thereby mounted on the first fire hole.

* * * * *